US008794936B2

(12) United States Patent
Tokuo et al.

(10) Patent No.: US 8,794,936 B2
(45) Date of Patent: Aug. 5, 2014

(54) HIGH-PRESSURE FUEL SUPPLY PUMP AND FUEL SUPPLY SYSTEM

(75) Inventors: Kenichiro Tokuo, Hitachinaka (JP); Jonathan Borg, Erding (DE)

(73) Assignee: Hitachi, Ltd., Tokyo (JP)

( * ) Notice: Subject to any disclaimer, the term of this patent is extended or adjusted under 35 U.S.C. 154(b) by 670 days.

(21) Appl. No.: 12/904,701

(22) Filed: Oct. 14, 2010

(65) Prior Publication Data

US 2011/0097228 A1 Apr. 28, 2011

(30) Foreign Application Priority Data

Oct. 28, 2009 (EP) ..... 09174393

(51) Int. Cl.
*F04B 53/10* (2006.01)
*F04B 7/00* (2006.01)

(52) U.S. Cl.
USPC ..... 417/442; 417/470; 417/505

(58) Field of Classification Search
USPC ..... 417/470, 442, 505, 440; 123/446, 447, 123/456, 458, 506
See application file for complete search history.

(56) References Cited

U.S. PATENT DOCUMENTS 4,782,803 A * 11/1988 Kikuchi ..... 123/300
7,263,973 B2 * 9/2007 Akita et al. ..... 123/431
2005/0268889 A1 12/2005 Kojima et al.
2006/0102149 A1 5/2006 Furusawa et al.
2007/0199542 A1 8/2007 Tokuda et al.
2009/0320796 A1 12/2009 Kojima et al.

FOREIGN PATENT DOCUMENTS

EP 1 701 031 A1 9/2006
EP 1 812 704 B1 3/2009
WO WO 2005/111409 A1 11/2005
WO WO 2008/078173 A1 7/2008

OTHER PUBLICATIONS

European Search Report dated Apr. 6, 2010 (Five (5) pages).

* cited by examiner

*Primary Examiner* — Bryan Lettman
(74) *Attorney, Agent, or Firm* — Crowell & Moring LLP

(57) ABSTRACT

A high-pressure fuel supply pump includes a compression chamber, a plunger reciprocating in the compression chamber for pressurizing fuel in the compression chamber, a discharge valve for discharging pressurized fuel from the compression chamber to a high-pressure fuel passage of a high-pressure fuel supply system for supplying high-pressure fuel to an internal combustion engine, and a first solenoid actuated valve for connecting and disconnecting a first low-pressure fuel passage and the compression chamber. The first solenoid actuated valve is biased by a first biasing member in a closing direction of the first solenoid actuated valve, and is opened or kept open against the biasing force of the first biasing member, when the first solenoid actuated valve is energized. The high pressure fuel supply pump further includes a second solenoid actuated valve for connecting and disconnecting a second low-pressure fuel passage and the compression chamber.

1 Claim, 19 Drawing Sheets

HIGH-PRESSURE FUEL SUPPLY PUMP AND FUEL SUPPLY SYSTEM

CLAIM OF PRIORITY

The present application claims priority from European patent application serial No. P09174393.0 filed on Oct. 28, 2009, the content of which is hereby incorporated by reference into this application.

BACKGROUND OF THE INVENTION

1. Field of the Invention

The pre sent invention relates to a high-pressure fuel supply pump for pressurizing fuel and delivering the pressurized fuel to an high-pressure fuel supply system of an internal combustion engine, the high-pressure fuel supply pump comprising a compression chamber, a plunger reciprocating in the compression chamber for pressurizing fuel in the compression chamber, a discharge valve for discharging pressurized fuel from the compression chamber to a high-pressure fuel passage of a high-pressure fuel supply system for supplying high-pressure fuel to an internal combustion engine, and a first solenoid actuated valve for connecting and disconnecting a first low-pressure fuel passage and the compression chamber, wherein the first solenoid actuated valve is biased by a first biasing member in a closing direction of the first solenoid actuated valve, and the first solenoid actuated valve is opened or kept open against the biasing force of the first biasing member, when the first solenoid actuated valve is energized.

Also, the present invention relates to a fuel supply system for supplying fuel to an internal combustion engine, the fuel supply system comprising a high-pressure fuel supply system for supplying high-pressure fuel to the internal combustion engine, a high-pressure fuel supply pump for pressurizing fuel and delivering pressurized fuel to the high-pressure fuel supply system, and a low-pressure fuel supply system for delivering low-pressure fuel to the high-pressure fuel supply pump, wherein the high-pressure fuel supply pump comprises a compression chamber, a plunger reciprocating in the compression chamber for pressurizing fuel in the compression chamber, a discharge valve for discharging pressurized fuel from the compression chamber to a high-pressure fuel passage of the high-pressure fuel supply system, and a first solenoid actuated valve for connecting and disconnecting a first low-pressure fuel passage of the low-pressure fuel supply system and the compression chamber, wherein the first solenoid actuated valve is biased by a first biasing member in an closing direction of the first solenoid actuated valve, and the first solenoid actuated valve is opened or kept open against the biasing force of the first biasing member, when the first solenoid actuated valve is energized.

2. Description of the Related Art

The demands and requirements for reducing exhaust gas emissions of internal combustion engines, e.g. of internal combustion engines of vehicles such as cars are continuously increasing as the environmental impact of pollution becomes more and more known, and in turn, exhaust gas emissions become more and more regulated. In particular, soot emissions regulations such as for example the soot emission regulations in Europe are becoming increasingly strict.

In order to provide a technology that may meet these regulations and future regulations, fuel supply systems for supplying fuel to an internal combustion engine using a hybrid solution have been proposed which combine a low-pressure fuel supply system for supplying low-pressure fuel to an internal combustion engine and a high-pressure fuel supply system for supplying high-pressure fuel to an internal combustion engine. Such hybrid systems are configured to either supply high-pressure fuel to the internal combustion engine, e.g. via gasoline direct injection, in short referred to as GDI (sometimes also referred to as spark ignition direct injection or SIDI in short), or to supply low-pressure fuel to the internal combustion engine, e.g. via port fuel injection, in short referred to as PFI. Accordingly, such hybrid fuel supply systems may for example supply fuel either in a GDI mode or in a PFI mode, and are potential candidates to allow for meeting the strict soot emission standards and future exhaust gas regulations.

Generally, such hybrid fuel supply system may, on the one hand, benefit from the low soot emission levels which may attained with a PFI engine, and, on the other hand, benefit from the improved fuel consumption of a GDI engine.

For example, such a hybrid fuel supply system is known from EP 1 812 704 A1 which has a low-pressure fuel supply system including intake manifold injectors and a low-pressure delivery pipe and, in addition thereto, a high-pressure fuel supply system including in-cylinder injectors, a high-pressure delivery pipe and a high-pressure fuel pump. A discharge flow rate of a low-pressure fuel pump which draws fuel from a tank to the low-pressure fuel system and the high-pressure fuel supply pump of the high-pressure fuel supply pump is set based on required supply quantities to the low-pressure fuel supply system and to the high-pressure fuel supply system obtained according to the engine operation conditions. However, according to EP 1 812 704 A1, the high-pressure fuel supply pump comprises a solenoid actuated inlet valve which is a so-called "normally open" inlet valve which is open when there is no current applied to a coil of the solenoid and which is closed when a current is applied to the solenoid. Controlling an amount of fuel delivered to a high-pressure delivery pipe with such normally open solenoid actuated inlet valves has the drawback that noise and vibrations occur during operation of the high-pressure fuel pump, when high-pressure fuel is delivered to the internal combustion engine e.g. in a GDI mode of the hybrid fuel supply system and the internal combustion engine. In particular, since the fuel supply system as described in EP 1 812 704 A1 comprises the normally open solenoid actuated inlet valve, which does not require to have electric energy applied when the internal combustion engine is operated in the PFI mode by delivering low-pressure fuel to the MPI injectors, it generates the characteristic high frequency ticking noise of a "normally open" solenoid actuated valve when operating as a flow rate control valve for delivering high-pressure fuel to the internal combustion engine. Moreover, there is a limitation in pump capacity, which is quite severe for a "normally open" solenoid actuated valve.

Furthermore, regarding the general development of such hybrid fuel supply systems being configured to deliver low-pressure fuel and/or high-pressure fuel to the internal combustion engine, there are many further challenges and problems regarding the fuel delivery system to be solved. For example, one of the main challenges is to adapt a high pressure fuel delivery system for the usage in a hybrid system combined with a low-pressure fuel system e.g. for PFI operation. Namely, in such systems, the high-pressure fuel delivery system has to be adapted so that the high pressure fuel system can withstand long times of non-usage, when the internal combustion engine is mainly supplied with low pressure fuel to attain the low soot emissions.

However, for adapting a high-pressure fuel supply system to such requirements, various issues have to be considered such as efficiently controlling of a fuel flow to zero in the high-pressure fuel system, i.e. when the low-pressure fuel is to be delivered to the internal combustion engine e.g. in a PFI mode and no fuel is to be pressurized, reducing noise and vibration levels during operation of the high-pressure fuel pump, which typically occurs for "normally open" solenoid actuated valves, reduce or even prevent deterioration of fuel in the high pressure fuel system, which typically occurs due to non circulation of fresh gasoline, when low-pressure fuel is to be delivered to the internal combustion engine e.g. in PFI mode and disadvantageously further leads to a heating up of fuel in the high-pressure fuel supply system so as to additionally heat up the high-pressure fuel supply system. Further challenges relate to the occurrence of deposits at the high-pressure fuel injector e.g. due to the above-mentioned fuel deterioration and issues regarding packaging, i.e. maintaining a compact structure despite an increasing number of components.

For reducing noise and vibrations during operation in a high-pressure fuel supply pump, EP 1 701 031 A1 shows a high-pressure fuel supply pump comprising a so-called "normally closed" solenoid actuated valve which enables the supply high-pressure fuel at a sufficient flow rate at a reduced noise level and with reduced occurrence of vibrations. Here, the term "normally closed" refers to the features that the solenoid actuated inlet valve of the high-pressure fuel supply pump is generally closed, when there is no current applied to a coil of the solenoid, e.g. by biasing the valve in the direction of closing the valve by means of a biasing member such as e.g. a spring. However, when current is applied and the solenoid is energized, the valve is opened or kept open by means of the electromagnetic force generated by the energized solenoid, in contrast to the operation of the above-mentioned "normally open" solenoid actuated valves. The high-pressure fuel supply pump described in EP 1 701 031 A1 comprising the normally closed inlet valve provides sufficient high-pressure fuel flow rate at reduced noise level and reduced vibrations. However, due to its basic structure, the high-pressure fuel pump of EP 1 701 031 A1 requires solenoid control at zero fuel flow conditions, e.g. when there is no high-pressure fuel to be supplied to an internal combustion engine. However, as mentioned above, supplying low-pressure fuel e.g. in PFI mode will be the predominant mode of operation in a low-pressure/high pressure hybrid fuel supply system (e.g. GDI (SIDI)+PFI) in order to meet the low soot emission requirements. Accordingly, electric energy has to be continuously applied to the high-pressure fuel pump in order to only deliver low-pressure fuel pressure e.g. during PFI mode. Moreover, the fuel remaining inside the high-pressure fuel pump during low-pressure fuel supply by the hybrid system will heat up and may, therefore, deteriorate, which may further lead to injector deposit problems and the like.

SUMMARY OF THE INVENTION

Starting from EP 1 701 031 A1, an object of the present invention is to modify the fuel pump or the fuel system for supplying high-pressure fuel to an internal combustion engine so as to solve the above-mentioned problems and challenges of the prior art, and provide a high-pressure fuel supply pump for pressurizing fuel and delivering the pressurized fuel to a high-pressure fuel supply system of an internal combustion engine and a fuel supply system for supplying low-pressure fuel and high-pressure fuel to an internal combustion engine which operate at reduced noise level and reduced vibrations compared to the hybrid fuel supply systems known from the prior art.

A further object of the present invention is to provide a high-pressure fuel supply pump for pressurizing fuel and delivering the pressurized fuel to a high-pressure fuel supply system of an internal combustion engine and a fuel supply system for supplying low-pressure fuel and high-pressure fuel to an internal combustion engine which retain the merits of a "normally closed" solenoid valve as described above while simultaneously addressing the challenges highlighted above, which further allows for efficient controlling of zero flow rate when no high-pressure fuel is supplied to an internal combustion engine.

It is yet a further object of the present invention to provide a high-pressure fuel supply pump for pressurizing fuel and delivering the pressurized fuel to a high-pressure fuel supply system of an internal combustion engine and a fuel supply system for supplying low-pressure fuel and high-pressure fuel to an internal combustion engine which allows a plurality of various operation modes.

The above-mentioned objects are solved according to the present invention by providing a high-pressure fuel supply pump for pressurizing fuel and delivering the pressurized fuel to a high-pressure fuel supply system of an internal combustion engine according to claim 1 and a fuel supply system for supplying fuel to an internal combustion engine according to claim 13.

In particular, a high-pressure fuel supply pump for pressurizing fuel and delivering the pressurized fuel to a high-pressure fuel supply system of an internal combustion engine according to the present invention and a fuel supply system for supplying fuel to an internal combustion engine according to the present invention share the common general inventive concept that there are provided two solenoid actuated valves. Namely, according to the general inventive concept of the present invention, there is provided a first solenoid actuated valve for connecting and disconnecting a first low-pressure fuel passage and the compression chamber of a high-pressure fuel supply pump and a second solenoid actuated valve for connecting and disconnecting a second low-pressure fuel passage and the compression chamber or at least for connecting and disconnecting the second low-pressure fuel passage and a high-pressure fuel passage of a high-pressure fuel supply system. According to the general inventive concept of the present invention, the first solenoid actuated valve is biased by a first biasing member in a closing direction of the first solenoid actuated valve and the first solenoid actuated valve is opened or kept open against the biasing force of the first biasing member, when said first solenoid actuated valve is energized, and the second solenoid actuated valve is configured to be closed, when said second solenoid actuated valve is energized, and the first low-pressure fuel passage and the second low-pressure fuel passage are connected to a low-pressure fuel supply system for supplying low-pressure fuel to the internal combustion engine.

According to the above-described general inventive concept of the present invention, the basic inventive idea is to combine two types of solenoid actuated valves, namely, a so-called "normally closed" solenoid actuated valve of the "normally closed"-type and a so-called "normally open" solenoid actuated valve of the "normally open"-type, in one single high-pressure fuel pump or in one fuel supply system such that the high-pressure fuel pump or the fuel supply system can achieve the benefit of sufficient flow rate and low impact noise as provided by a "normally closed" solenoid actuated valve high-pressure fuel supply pump configuration and which, in addition, has the functionality provided by a "normally open" solenoid actuated valve, which does not deliver fuel when there is no control signal such that the "normally open" solenoid actuated valve is deenergized. At the same time, the present invention provides the additional advantage that fuel recirculation during PFI injection operation mode is enabled for cooling down the high-pressure pump and the low fuel-passages with fresh fuel by connecting the compression chamber and the low-pressure fuel passage.

According to the present invention, a high-pressure fuel supply pump comprises a compression chamber, a plunger reciprocating in the compression chamber for pressurizing fuel in the compression chamber, a discharge valve for discharging pressurized fuel from the compression chamber to a high-pressure fuel passage of a high-pressure fuel supply system for supplying high-pressure fuel to an internal combustion engine, and/or a first solenoid actuated valve for connecting and disconnecting a first low-pressure fuel passage and the compression chamber, wherein the first solenoid actuated valve is biased by a first biasing member in a closing direction of the first solenoid actuated valve, and the first solenoid actuated valve is opened or kept open against the biasing force of the first biasing member, when the first solenoid actuated valve is energized. The high-pressure fuel supply pump according to the present invention is characterized by a second solenoid actuated valve for connecting and disconnecting a second low-pressure fuel passage and the compression chamber, wherein the second solenoid actuated valve is configured to be closed, when the second solenoid actuated valve is energized, and the first low-pressure fuel passage and the second low-pressure fuel passage are connected to a low-pressure fuel supply system for supplying low-pressure fuel to the internal combustion engine.

Accordingly, the present invention provides a high-pressure fuel supply pump which utilizes the merits of both types of solenoid valves, i.e. a "normally closed" solenoid valve and a "normally open" solenoid valve. Therefore, operation noises and vibrations may be reduced and energy consumption can be reduced. Additionally, such a configuration of the present invention provides plural various possible modes of operation (modes of solenoid control) which can be used depending on the various requirements, including plural high-pressure fuel supply modes, plural low-pressure fuel supply modes, pressure relief modes, synchronization modes and anti-failure modes.

Preferably, the second solenoid actuated valve is biased by a second biasing member in an opening direction of the second solenoid actuated valve, wherein the second solenoid actuated valve is preferably configured to be closed and/or kept closed against the force of the second biasing member, when the second solenoid actuated valve is energized.

Alternatively, the second solenoid actuated valve may be configured without any biasing member such that the second solenoid actuated valve can be opened merely by hydraulic force during an upward stroke of the plunger, wherein the second solenoid actuated valve is preferably further configured to be closed and/or kept closed to against the hydraulic force, when the second solenoid actuated valve is energized.

Further alternatively, the second solenoid actuated valve can be biased by a second biasing member in a closing direction of the second solenoid actuated valve, wherein the biasing force of the second biasing member is smaller than a hydraulic force during an upward stroke of the plunger so that the second solenoid actuated valve can be opened merely by hydraulic force during an upward stroke of the plunger against the biasing force of the second biasing member, wherein the second solenoid actuated valve is preferably configured to be closed and/or kept closed against the hydraulic force, when the second solenoid actuated valve is energized. Accordingly, by providing a second biasing member acting a biasing force in the closing direction of the second solenoid actuated valve which biasing force is smaller than the hydraulic force during the upward stroke of the plunger, the response time of the second solenoid actuated valve can be made faster, wherein the second solenoid actuated valve still can function as normally open valve according to the invention.

The second solenoid actuated valve may be a push-type valve, which preferably comprises a valve seat, and a push rod for coming in contact with the valve seat for closing the valve, when the second solenoid actuated valve is energized so that the push rod is preferably pushed by magnetic force until the push rod comes in contact with the valve seat, wherein the push rod is preferably pulled by the biasing force of the second biasing member from the valve seat and/or pushed by hydraulic force during an upward stroke of the plunger from the valve seat to open the valve, when the second solenoid actuated valve is deenergized.

Alternatively, the second solenoid actuated valve may also be a pull-type valve, which preferably comprises a valve seat, a valve body for coming in contact with the valve seat for closing the valve, the valve body preferably being biased by a third biasing member in the direction of closing the valve, and/or a pull rod for coming in contact with the valve body, the pull rod preferably being biased by the biasing force of the second biasing member in the direction of opening the valve so that the valve is preferably opened or kept open against the biasing force of the third biasing member, when the second solenoid actuated valve is deenergized, and the pull rod is preferably pulled from the valve body by magnetic force against the biasing force of the second biasing member so that the second solenoid actuated valve is preferably closed by the biasing force of the third biasing member, when the second solenoid actuated valve is energized.

Preferably, the low-pressure fuel supply system comprises at least one low-pressure fuel rail which preferably has at least one fuel injection means for injecting low-pressure fuel into an intake air passage of the internal combustion engine.

Preferably, the high-pressure fuel supply system comprises at least one high-pressure fuel rail which preferably has a plurality of gasoline direct injection means for injecting high-pressure fuel directly into a plurality of cylinders of the internal combustion engine.

Preferably, in a first operation mode of the high-pressure fuel supply pump, the high-pressure fuel supply pump is preferably controlled such that the first solenoid actuated valve and the second solenoid actuated valve are continuously kept deenergized, wherein the second solenoid actuated valve is preferably continuously kept open and fuel is preferably spilled out of the compression chamber through the second solenoid actuated valve in the upward stroke of the plunger without pressurizing fuel in the compression chamber so that the internal combustion engine is preferably only supplied with low-pressure fuel by the low-pressure fuel supply system. Such a mode of operation provides a low-pressure fuel supply mode such as PFI mode at reduced noise and vibrations in a very quiet operation without any requirement of consumption of electrical energy in the operation of the high-pressure fuel supply pump.

Preferably, in a second operation mode of the high-pressure fuel supply pump, the high-pressure fuel supply pump is preferably controlled such that the second solenoid actuated valve is continuously kept energized so as to be kept closed by magnetic force, wherein the first solenoid actuated valve is preferably opened or kept open by hydraulic force and/or magnetic force so as to function as an inlet valve for delivering low-pressure fuel into the compression chamber during an intake stroke of the plunger and preferably as a spill valve for spilling low-pressure fuel out of the compression chamber during an upward stroke of the plunger, wherein the first solenoid actuated valve is preferably deenergized during the upward stroke of the plunger for closing the first solenoid actuated valve by hydraulic force so that fuel in the compression chamber is pressurized and delivered to the high-pressure fuel supply system through the discharge valve. Such a mode of operation provides a high-pressure fuel supply mode such as GDI mode at reduced noise and vibrations in a very quiet operation.

Preferably, in a third operation mode of the high-pressure fuel supply pump, the high-pressure fuel supply pump is preferably controlled such that the second solenoid actuated valve is continuously kept closed, wherein the second solenoid actuated valve is preferably kept deenergized during an upward stroke of the plunger so as to be kept closed by hydraulic force during the upward stroke of the plunger and, wherein the second solenoid actuated valve is preferably kept energized from the end of the upward stroke, during an intake stroke, and preferably until the beginning of a next upward stroke of the plunger so as to be kept closed by magnetic force, wherein the first solenoid actuated valve is preferably opened or kept open by hydraulic force and/or magnetic force so as to function as an inlet valve for delivering low-pressure fuel into the compression chamber during the intake stroke of the plunger and preferably as a spill valve for spilling low-pressure fuel out of the compression chamber during the upward stroke and the next upward stroke of the plunger, wherein the first solenoid actuated valve is preferably deenergized during the upward stroke and the next upward stroke of the plunger for closing the first solenoid actuated valve by hydraulic force so that fuel in the compression chamber is pressurized and delivered to the high-pressure fuel supply system through the discharge valve. Such a mode of operation provides an alternative high-pressure fuel supply mode such as GDI mode in which energy consumption can be further reduced.

Preferably, in a fourth operation mode of the high-pressure fuel supply pump, the high-pressure fuel supply pump is preferably controlled such that pressurizing fuel in the compression chamber is started by deenergizing the first solenoid actuated valve during an upward stroke of the plunger while the second solenoid actuated valve is preferably kept energized, and pressurizing fuel is preferably stopped by deenergizing the second solenoid actuated valve. Such a mode of operation provides the possibility of advantageous pressure relief and/or of a very advantageous control of the timing and the amount of discharged high-pressure fuel e.g. for synchronization with injection events.

Preferably, in a fifth operation mode of the high-pressure fuel supply pump, the high-pressure fuel supply pump is preferably control led such that the first solenoid actuated valve is continuously kept deenergized, wherein the second solenoid actuated valve preferably functions as an inlet valve for delivering low-pressure fuel into the compression chamber during an intake stroke of the plunger and preferably as an spill valve for spilling low-pressure fuel out of the compression chamber during an upward stroke of the plunger, wherein the second solenoid actuated valve is preferably energized during the upward stroke of the plunger for closing the second solenoid actuated valve so that fuel in the compression chamber is pressurized and delivered to the high-pressure fuel supply system through the discharge valve. Such a mode of operation provides an alternative high-pressure fuel supply mode such as GDI mode which provides the advantageous possibility of a failure mode, e.g. when the first solenoid actuated valve has a failure and the second solenoid valve can be used to control the high-pressure fuel supply.

Preferably, the first solenoid actuated valve and/or the second solenoid actuated valve are respectively controlled via pulse-width modulation, wherein the first solenoid actuated valve and/or the second solenoid actuated valve are preferably controlled at a duty cycle of substantially 100% after being energized for magnetizing the solenoid, and wherein the first solenoid actuated valve and/or the second solenoid actuated valve are preferably controlled at a duty cycle below 100% after magnetization of the solenoid for keeping the first solenoid actuated valve and/or the second solenoid actuated valve energized. In such an operation mode, which can be applied to all described operation modes, energy consumption can be further reduced.

In the following, the fuel supply system according to the present invention. Of course, the below described fuel system may be combined with any of the above-described features and aspects de scribed with reference to the high-pressure fuel supply pump. In particular, the above-described modes of operation also can be applied to the below described fuel system according to the present invention.

According to the present invention, a fuel supply system for supplying fuel to an internal combustion engine comprises a high-pressure fuel supply system for supplying high-pressure fuel to the internal combustion engine, a high-pressure fuel supply pump for pressurizing fuel and delivering pressurized fuel to the high-pressure fuel supply system, and/or a low-pressure fuel supply system for delivering low-pressure fuel to the high-pressure fuel supply pump, wherein the high-pressure fuel supply pump comprises a compression chamber, a plunger reciprocating in the compression chamber for pressurizing fuel in the compression chamber, a discharge valve for discharging pressurized fuel from the compression chamber to a high-pressure fuel passage of the high-pressure fuel supply system, and/or a first solenoid actuated valve for connecting and disconnecting a first low-pressure fuel passage of the low-pressure fuel supply system and the compression chamber, wherein the first solenoid actuated valve is biased by a first biasing member in an closing direction of the first solenoid actuated valve, and the first solenoid actuated valve is opened or kept open against the biasing force of the first biasing member, when the first solenoid actuated valve is energized. According to the present invention, the low-pressure fuel supply system is further configured to directly supply low-pressure fuel to the internal combustion engine, wherein a second solenoid actuated valve is provided for connecting and disconnecting a second low-pressure fuel passage of the low-pressure fuel supply system and the compression chamber of the high-pressure fuel supply pump or for connecting and disconnecting a second low-pressure fuel passage of the low-pressure fuel supply system and a high-pressure fuel passage of the high-pressure fuel system, and the second solenoid actuated valve is closed, when the second solenoid actuated valve is energized.

Preferably, the second solenoid actuated valve is biased by a second biasing member in an opening direction of the second solenoid actuated valve, and the second solenoid actuated valve is preferably closed against the biasing force of the second biasing member, when the second solenoid actuated valve is energized.

Preferably, the high-pressure fuel supply system comprises a high-pressure sensor means for determining a pressure of the pressurized fuel in the high-pressure fuel supply system, wherein the second solenoid actuated valve is preferably controlled so as to be deenergized, when the pressure of the pressurized fuel in the high-pressure fuel supply system determined by the high-pressure sensor means is equal to or above a predetermined high-pressure threshold value.

The second solenoid actuated valve may be comprised in the high-pressure fuel supply pump for connecting and disconnecting the second low-pressure fuel passage of the low-pressure fuel supply system and the compression chamber of the high-pressure fuel supply pump so that the high-pressure fuel supply pump preferably is a high-pressure fuel supply pump according to at least one of the above-described high-pressure fuel supply pumps according to the present invention.

Alternatively, the high-pressure fuel supply system may comprise a high-pressure fuel rail having a plurality of gasoline direct injection means for directly injecting pressurized fuel into a plurality of cylinders of the internal combustion engine, wherein the second solenoid actuated valve is preferably configured to connect and disconnect the high-pressure fuel rail of the high-pressure fuel supply system and the second low-pressure fuel passage of the low-pressure fuel supply system. Still, the above modes of operation can be applied. Furthermore, the second solenoid actuated valve of the system may preferably be a push type valve as described above.

Further preferably, the low-pressure fuel supply system comprises at least one low-pressure fuel rail preferably having at least one fuel injection means for injecting low-pressure fuel into an intake air passage of the internal combustion engine, wherein the low-pressure fuel rail preferably comprises a low-pressure sensor means for determining a pressure of low-pressure fuel in one of the at least one low-pressure fuel rail, the second low-pressure fuel passage is preferably connected to the at least one low-pressure fuel rail for delivering low-pressure fuel to the at least one low-pressure fuel rail, and/or the first low-pressure fuel passage and the second low-pressure fuel passage are preferably connected by a third low-pressure fuel passage comprising a flow-rate reducing means for reducing a flow-rate of fuel from the second low-pressure fuel pas sage to the first low-pressure fuel passage, preferably if the pressure of fuel in the second low-pressure fuel passage is larger than the pressure of fuel in the first low-pressure fuel passage. This provides the advantage that the pressure in the low-pressure system may be enhanced on the rail side of the flow-rate reducing means by means of controlling the solenoid valves.

Accordingly, a pressure of low pressure fuel supplied from a tank by a low-pressure fuel pump can be reduced so that a more compact low-pressure fuel pump can be provided at the tank. Delivering low-pressure fuel to the at least one low-pressure fuel rail is then preferably controlled by the first and second solenoid actuated valves, wherein the first solenoid actuated valve is preferably controlled so as to be deenergized during an upward stroke of the plunger to start pressurizing of fuel in the compression chamber, and the second solenoid actuated valve is preferably controlled so as to be deenergized, when the pressure of the pressurized fuel in the at least one low-pressure fuel rail determined by the low-pressure sensor means is equal to or above a predetermined low-pressure threshold value.

The above-described aspects and features of the present invention may be combined in any way, party or as a whole. The above-described aspects and features of the present invention and advantages thereof will become more apparent from the following detailed description of preferred embodiments, which will be described with reference to the accompanying figures.

DESCRIPTION OF THE PREFERRED EMBODIMENTS

Preferred embodiments of the present invention will be described below with reference to the figures. It is to be noted that the described features and aspects of the embodiments may be modified or combined to form further embodiments of the present invention.

The present invention has the single general inventive concept of combining a so-called "normally open" solenoid actuated valve and a so-called "normally closed" solenoid actuated valve. A cam lobe 40 is provided to give the reciprocating movement to the plunger 9. Accordingly, a high-pressure fuel supply pump or a fuel supply system according to the present invention has two solenoid actuated valves for controlling the fuel supply of the high pressure fuel pump or the fuel supply system to the high pressure fuel injectors for supplying high-pressure fuel to the internal combustion engine, namely, a so-called "normally open" solenoid actuated valve and a so-called "normally closed" solenoid actuated valve. In particular, one of the solenoid actuated valves is a so-called "normally closed" solenoid valve, i.e., the valve closes when there is no actuation signal, namely, when there is no current applied to the solenoid valve. The second solenoid valve is a so-called "normally open" solenoid actuated valve, which is kept open when there is no actuation signal provided, namely, when there is no current applied to the solenoid valve.

Figure 1:
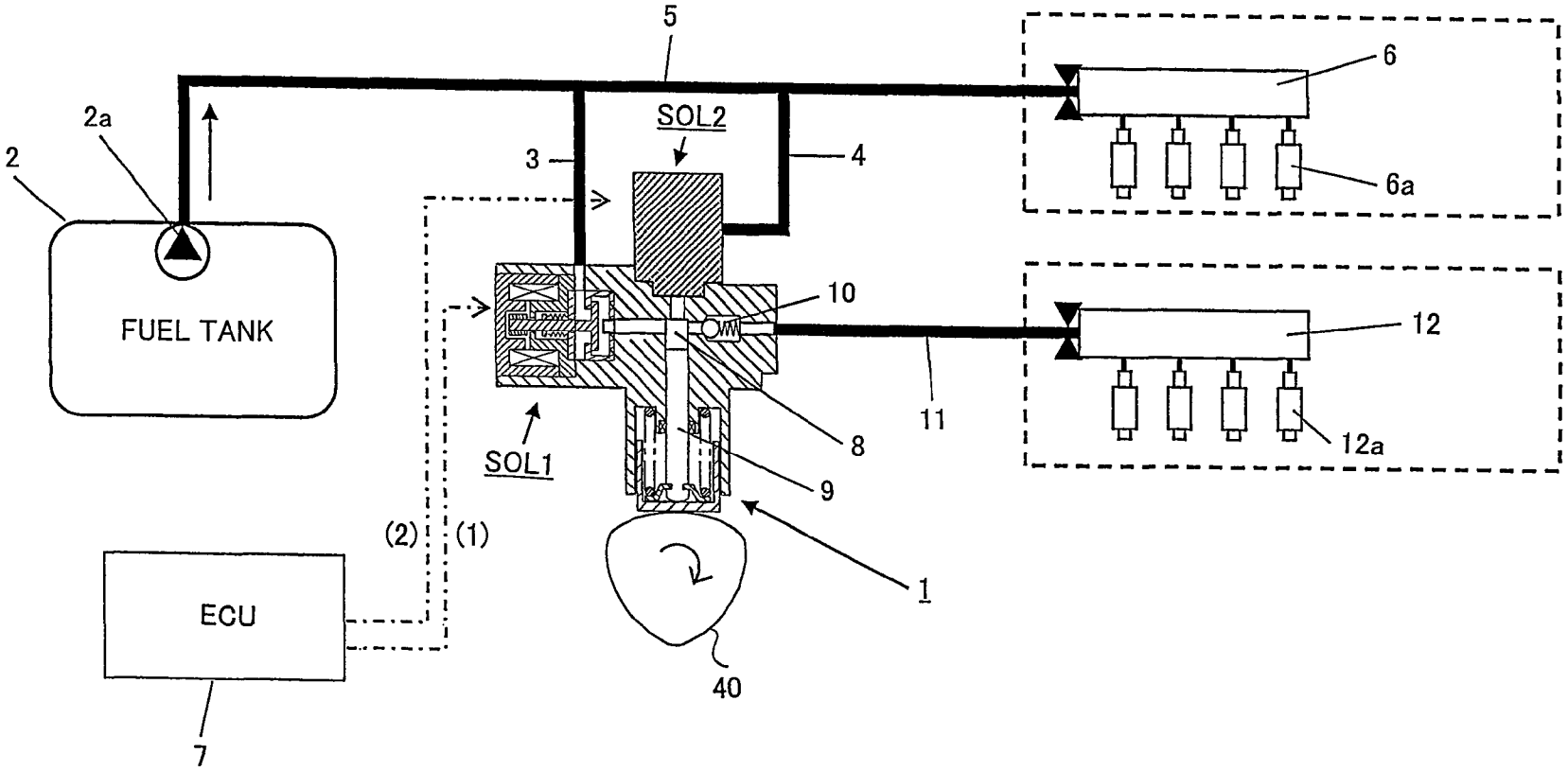
FIG. 1 shows a schematic drawing of a high-pressure fuel supply pump according to an example of the first and second embodiment of the present invention and a corresponding fuel supply system.

FIG. 1 shows a high-pressure fuel supply pump 1 according to an embodiment of the present invention and a fuel supply system according to an embodiment of the present invention, where the high-pressure fuel supply pump is provided in the fuel supply system. The high-pressure fuel supply pump 1 comprises a first solenoid actuated valve SOL1 and a second solenoid actuated valve SOL2 for controlling the flow rate of high-pressure fuel supplied to an internal combustion engine.

According to this embodiment of the present invention, the first solenoid actuated valve SOL 1 is a so-called "normally closed" solenoid actuated valve and the second solenoid actuated valve SOL 2 is a so-called "normally open" solenoid actuated valve. More precisely, when there is no current supplied to the solenoid of the first solenoid actuated valve SOL 1, the first solenoid actuated valve SOL 1 is generally closed (or opened by a force other than the electromagnetic force such as a hydraulic force or the like) and the first solenoid actuated valve SOL is configured to be opened and/or kept open by means of electromagnetic force in that current is applied to the solenoid of the first solenoid actuated valve SOL 1. However, when there is no current supplied to the solenoid of the second solenoid actuated valve SOL 2, the second solenoid actuated valve SOL 2 is generally open (e.g. by means of a biasing member such as a spring or a spring mechanism or also by means of a hydraulic force) and the second solenoid actuated valve SOL 2 is configured to be closed and/or kept closed by means of electromagnetic force in that current is applied to the solenoid of the second solenoid actuated valve SOL 2.

In FIG. 1, the fuel supply system further comprises a fuel tank 2 comprising fuel which can be delivered by a low-pressure fuel pump 2*a* to a low-pressure fuel main passage 5 of a low-pressure fuel system which comprises a first low-pressure fuel passage 3 and a second low-pressure fuel passage 4 which are both connected to the low-pressure fuel main passage 5. The first low-pressure fuel passage 3 is further connected to the first solenoid actuated valve SOL 1 and the second low-pressure fuel passage 4 is further connected to the second solenoid actuated valve SOL 2 so that low-pressure fuel can be delivered from the fuel tank 2 via the low-pressure fuel main passage 5 to the solenoid actuated valves SOL1 and SOL 2 and so that fuel which is spilled out at low-pressure from the high-pressure fuel pump 1 can be delivered (spilled) to the low-pressure fuel main passage 5 via the first low-pressure fuel passage 3 and the second low-pressure fuel passage 4 depending on the particular mode of the control operation of the solenoid actuated valves SOL1 and SOL 2 (the various possible modes of the control operation of the solenoid actuated valves SOL1 and SOL 2 according to the present invention will be described in detail later).

Furthermore, the low-pressure fuel main passage 5 is further connected to a low-pressure fuel rail 6 comprising four injection means 6*a* for injecting low-pressure fuel into an intake air passage of an internal combustion engine (not shown). These injection means 6*a* can be for example PFI injectors for port fuel injection. Accordingly, when the high-pressure fuel supply pump 1 is controlled such that no high-pressure fuel is supplied to the internal combustion engine, the fuel supply system supplies low-pressure fuel to the intake air passage of the internal combustion engine, e.g. in a PFI mode of the fuel supply system and the internal combustion engine. For controlling the high-pressure fuel pump 1, more precisely, for controlling separately the solenoid actuated valves SOL1 and SOL2, an engine control unit 7 is provided.

The high-pressure fuel pump 1 of FIG. 1 further comprises a compression chamber 8, a plunger 9 reciprocating in the compression chamber 8 for pressurizing fuel in the compression chamber 8, and a discharge valve 10 for discharging pressurized fuel from the compression chamber 8 to a high-pressure fuel passage 11 for supplying high-pressure fuel to an internal combustion engine. The high-pressure fuel passage 11 is connected to the discharge valve 10 of the high-pressure fuel supply pump and the high-pressure fuel passage 11 is further connected to a high-pressure fuel rail 12 comprising four gasoline direct injection means 12*a* for injecting high-pressure fuel directly into the cylinders of the internal combustion engine. The gasoline direct injection means 12*a* can for example be SIDI injectors. Accordingly, when the high-pressure fuel supply pump 1 is controlled such that high-pressure fuel is supplied to the internal combustion engine, the fuel supply system supplies high-pressure fuel which is pressurized in the compression chamber 8 and discharged via the discharge valve 10 to the internal combustion engine in that the high-pressure fuel is directly injected into cylinders of the internal combustion engine at high-pressure, e.g. in a GDI mode or SIDI mode of the fuel supply system and the internal combustion engine.

Accordingly, a hybrid fuel supply system is provided for supplying low-pressure fuel to the internal combustion engine, e.g. in a PFI mode, and for supplying high-pressure fuel to the internal combustion engine, e.g. in GDI mode.

According to such a structure as described above with reference to FIG. 1, the first solenoid actuated valve SOL1 can be controlled for controlling the fuel flow into the compression chamber 8 so as to function as an inlet valve of the high-pressure fuel supply pump 1. The first solenoid actuated valve SOL1 is closed when there is no actuation signal from the ECU 7, i.e. when there is no current supplied to the solenoid of the first solenoid actuated valve SOL1, so that no fuel can be spilled out from the compression chamber 8 via the first solenoid actuated valve SOL1. The second solenoid actuated valve SOL2 is a "normally open" solenoid actuated valve which is kept open in the absence of an actuation signal, i.e. when there is no actuation signal from the ECU 7, i.e. when there is no current supplied to the solenoid of the second solenoid actuated valve SOL2. The flow rate can be for example controlled by the first solenoid actuated valve SOL1, which makes it possible to avoid the typical high frequency ticking noise of "normally open" type solenoid valves as the first solenoid actuated valve SOL1 is a "normally closed" type solenoid valve, when the internal combustion engine is supplied with high-pressure fuel such as in GDI mode.

Further, the presence of the second solenoid actuated valve SOL2 can be used to prevent compression of the fuel in the compression chamber 8 in the absence of any control signal, i.e. when there is neither current applied to the solenoid of the first solenoid actuated valve SOL1 nor to the solenoid of the second solenoid actuated valve SOL2, thereby enabling the high-pressure fuel supply pump and the fuel supply system to output no pressurized high-pressure fuel, when there is no control signal provided. Accordingly, an energy efficient low-pressure supply mode of the hybrid fuel supply system such as a PFI mode can be provided since there is no requirement of supplying electric energy to the solenoids during the low-pressure supply mode such as a PFI mode.

The low pressure passage connects the fuel tank and the inlet of SOL1, to supply low pressure fuel to the high pressure pump. SOL2 controls the passage between the compression chamber of the high pressure pump and the low pressure passage. Normally, when SOL2 is switched off, it opens the connection so that fuel in the compression chamber will spill out to the low pressure passage (i.e., preventing compression of the fuel). When SOL2 is switched on, it closes the spill passage; this enables fuel pressurization within the compression chamber during the upward stroke of the pump plunger, depending on the control action applied to SOL1.

Accordingly, the basic idea and general inventive concept of the present invention is to combine these two types of solenoid actuated valves, i.e. a "normally closed" type solenoid valve and a "normally open" type solenoid valve, into one high pressure fuel pump (cf. FIG. 1) or a fuel supply system (e.g. either in the high-pressure fuel supply pump, i.e. as a chamber valve connected to the compression chamber of the high-pressure fuel supply pump or also elsewhere in the high-pressure fuel supply system, e.g. for connecting/disconnecting the high-pressure fuel passage 11 with the low-pressure fuel system such as e.g. with the low-pressure fuel main passage 5 or the low-pressure fuel rail 6, or for connecting/disconnecting the high-pressure fuel rail 12 with the low-pressure fuel system such as e.g. with the low-pressure fuel main passage 5 or the low-pressure fuel rail 6) so that the fuel supply system can benefit from the high flow rate and reduced impact noise of a "normally closed" solenoid valve while at the same time enabling the functionality of a "normally open" solenoid valve which enables that there is no high-pressure fuel delivered to the internal combustion engine in the absence of a control signal, i.e. when there is no electric energy supplied to the solenoids of the valves SOL1 and SOL2.

It should be noted that the high-pressure fuel supply pump is mechanically connected to a rotating shaft (typically the cam-shaft) via a pump driving lobe. This applies in all modes of operation (e.g. GDI mode and/or PFI mode). This means that even during a period in which the high-pressure fuel is not required to be delivered to the internal combustion engine, i.e. in which the fuel is not required to be pressurized in the compression chamber 8, such as e.g. during a PFI operation mode, the plunger 9 of the high-pressure fuel supply pump is still reciprocating in the compression chamber and pressurization of fuel in the compression chamber should be prevented during low-pressure fuel supply mode such as PFI mode. Providing the first solenoid actuated valve SOL1 and the second solenoid actuated valve SOL2 (in the fuel pump or as a part of the fuel supply system outside the fuel pump) according to the single general inventive concept of the present invention enables the continuous supply of fuel to the compression chamber 8 of the high-pressure fuel supply pump and spilling out of the fuel. Hence, lubrication of the moving parts of the pump e.g. in the compression chamber 8 such as the plunger 9 can be assured even during low-pressure fuel supply mode such as PFI mode. This provides a very important advantage regarding the durability of the dual fuel system according to the invention. Additionally, by connecting the compression chamber 8 and the low-pressure fuel main passage 5, fuel recirculation during low-pressure fuel supply mode such as PFI mode is enabled so that cooling of the high-pressure fuel supply pump and fuel pipe with fresh fuel of the low-pressure fuel system can be enabled.

The above-mentioned advantages apply to all of the below described specific embodiments of the present invention which relate to particular embodiments of the present invention sharing the above-mentioned single general inventive concept, where the first embodiment relates to a fuel supply system comprising a high-pressure fuel supply pump comprising the first solenoid actuated valve SOL1 and the second solenoid actuated valve SOL2, which is a push type valve, the second embodiment relates to a fuel supply system comprising a high-pressure fuel supply pump comprising the first solenoid actuated valve SOL1 and the second solenoid actuated valve SOL2, which is a pull type valve, and the third embodiment relates to a fuel supply system comprising a high-pressure fuel supply pump comprising the first solenoid actuated valve SOL1, wherein the second solenoid actuated valve SOL2 is provided for connecting and disconnecting the high-pressure fuel rail 12 with the low-pressure fuel main passage 5.

Figure 2A:
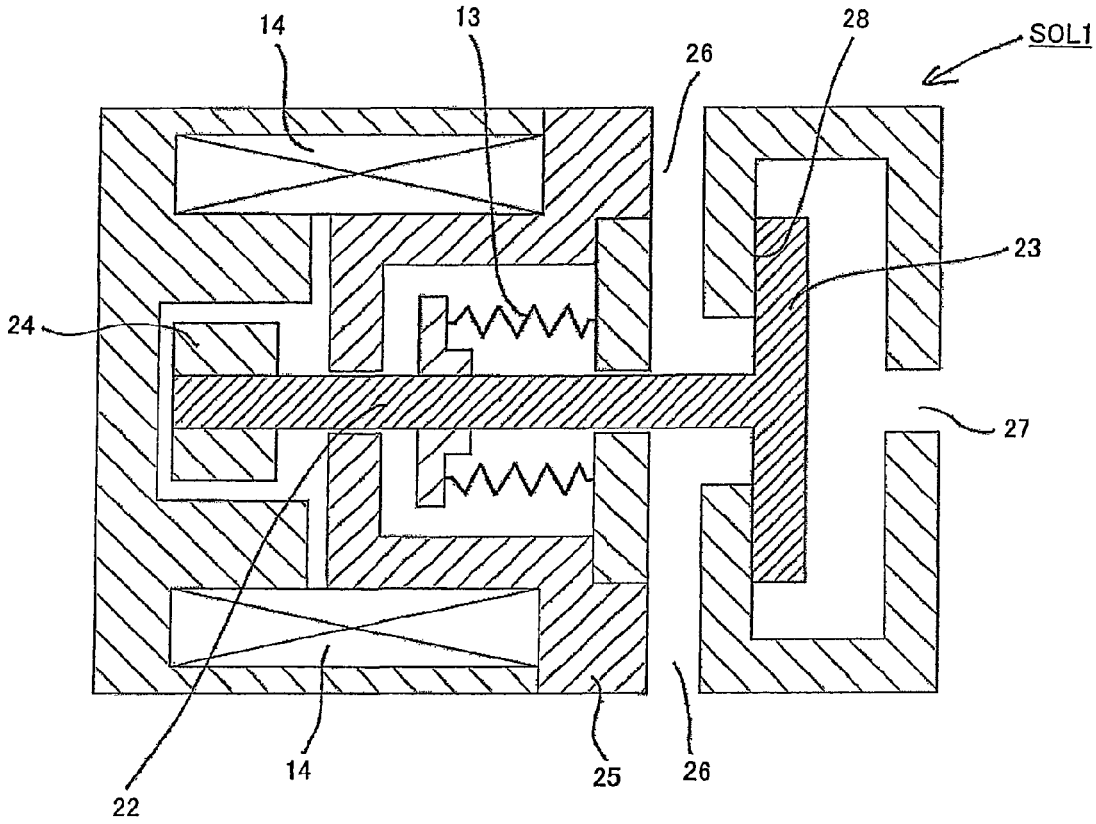
FIGS. 2A and 2B show schematic drawings of an example of a first solenoid actuated valve according to the embodiments of the present invention. The valve is shown in the open state in FIG. 2A and in the closed state in FIG. 2B.
Figure 2B:
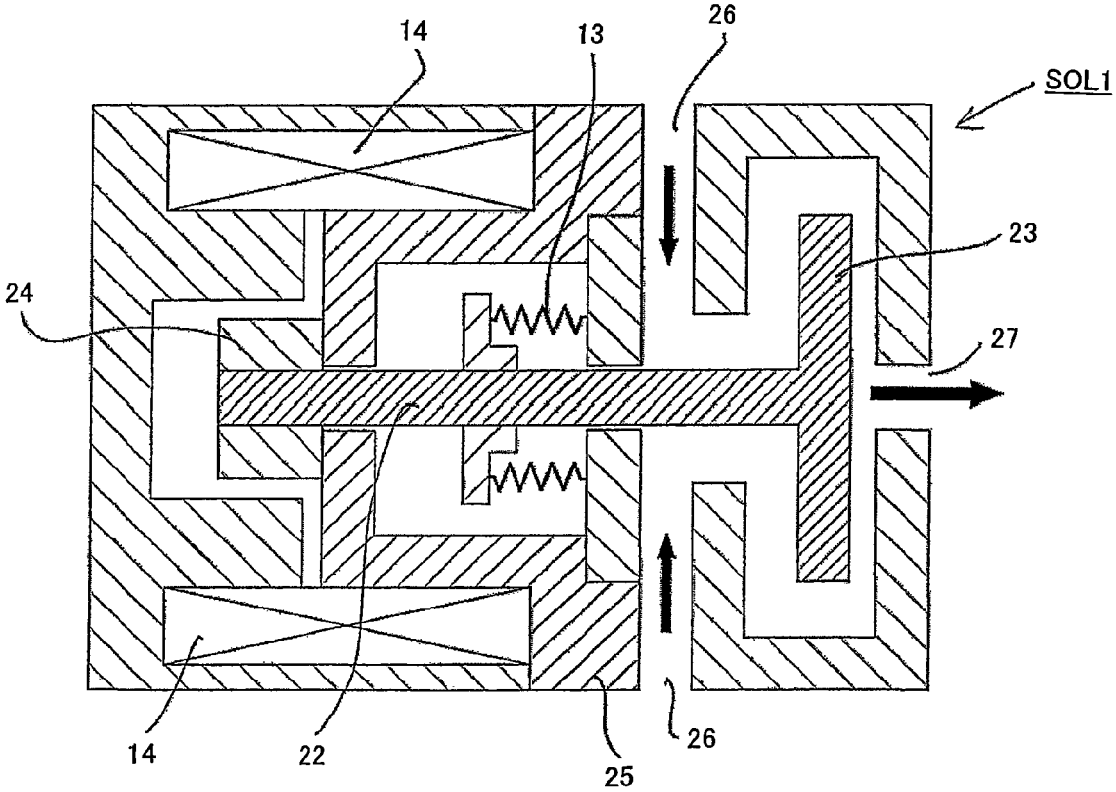

FIGS. 2A and 2B show an example of a "normally closed" solenoid actuated valve which can be used for a first solenoid actuated valve SOL1 according to the embodiments of the present invention. In FIG. 2B, the "normally closed" solenoid actuated valve SOL 1 is shown in the open state, i.e. when current is applied to the coil 14, and in FIG. 2A, the "normally closed" solenoid actuated valve SOL1 is shown in the closed state, i.e. when no current is applied to the coil 14 and there is no hydraulic pressure, i.e. there is no pressure difference between upstream and downstream of the valve. The "normally closed" solenoid actuated valve SOL 1 in FIGS. 2A and 2B comprises a valve rod 22 and a valve member 23. Here, the valve rod 22 and the valve member 23 are formed as a unitary body, however, the valve rod 22 and the valve member 23 can also be formed as separate bodies. Furthermore, an anchor 24 is provided at the other end of the valve rod 22, i.e. at the end on the side opposite of the valve rod 22 than the valve member 23. When current is applied to the coil 14, the anchor 24 and a core 25 of the solenoid valve are attracted to each other by magnetic force so that the valve rod 22 is displaced in the direction of opening the valve until the anchor 24 and the core 25 come in contact so that the displacement of the valve rod 22 is restricted.

As long as current is applied to the coil 14, the anchor 24 and the core 25 remain attracted to each other so as to stay in contact so that the valve can be kept open in that the valve member 23 is kept away from valve seat 28. Accordingly, low-pressure fuel can be drawn from the low-pressure system via the small passage 26 as indicated by the arrow and be delivered to the compression chamber 8 of the high-pressure fuel supply pump via the inlet passage 27 as further indicated by the arrow. Of course, non-pressurized fuel can also be spilled backwards through the inlet passage 27 via the small passage 26 to the low-pressure fuel system as long as the valve is kept open by applying current to coil 14, when the plunger 9 in the compression chamber 8 is in an upward stroke so as to decrease the volume of the compression chamber 8.

However, when there is no current applied to the coil 14, the spring 13 biases the valve rod 22 in the direction of closing the valve until the valve member 23 comes in contact with the valve seat 28 for closing the valve as shown in FIG. 2A. Accordingly, in an upward stroke of the plunger 9 in the compression chamber 8, fuel cannot spill out through the inlet passage 27 and fuel is pressurized in the compression chamber 8 so as to be discharged through the discharge valve 10 at high pressure. On the other hand, when there is no current applied to the coil 14, and the plunger 9 is in an intake stroke (downward stroke) so as to increase the volume of the compression chamber 8, the fuel pressure in the compression chamber 8 decreases in comparison to the pressure of fuel in the small passage 26 which is connected to the low-pressure fuel system so that a hydraulic force is generated which can cause the displacement of the valve member 23 in the direction of opening the valve against the biasing force of the spring 13 even without applying current to the coil 14. The hydraulic force can either cause a full displacement of the valve rod 22 and/or the valve member 23 until the anchor 24 comes in contact with the core 25 or a displacement which is not a full displacement of the valve rod 22 and/or the valve member 23 until the anchor 24 comes in contact with the core 25.

Thereafter, when current is applied to the coil 14, i.e. when the solenoid is energized, the magnetic force causes the valve to open and/or be kept open. Especially in a structure as shown in FIGS. 2A and 2B, where the valve rod 22 is displaced together with the valve member 23 before the current is applied to the coil 14, a noise level and vibrations can be efficiently reduced during the operation of the "normally closed" solenoid actuated valve. Here, this is achieved in that the valve rod 22 and the valve member 23 are formed as a unitary body. However, the valve rod 22 and the valve member 23 can also be formed as separate bodies which are fixed to each other or as separate bodies where the valve rod 22 and the valve member 23 are biased by a biasing mechanism to the direction of closing the valve, where the valve rod 22 is further biased in the direction of the valve member 23 so that the valve rod 22 is displaced by a biasing force in the direction of opening the valve, when the valve member 23 is displaced to the direction of opening the valve by means of the hydraulic force.

First Embodiment

In the following, a first embodiment of a high-pressure fuel supply pump and a corresponding fuel supply system according to the present invention will be described. The general structure of this first embodiment of a high-pressure fuel supply pump and a corresponding fuel supply system according to the present invention is the structure as shown in FIG. 1 and described above with reference to FIG. 1.

Figure 3:
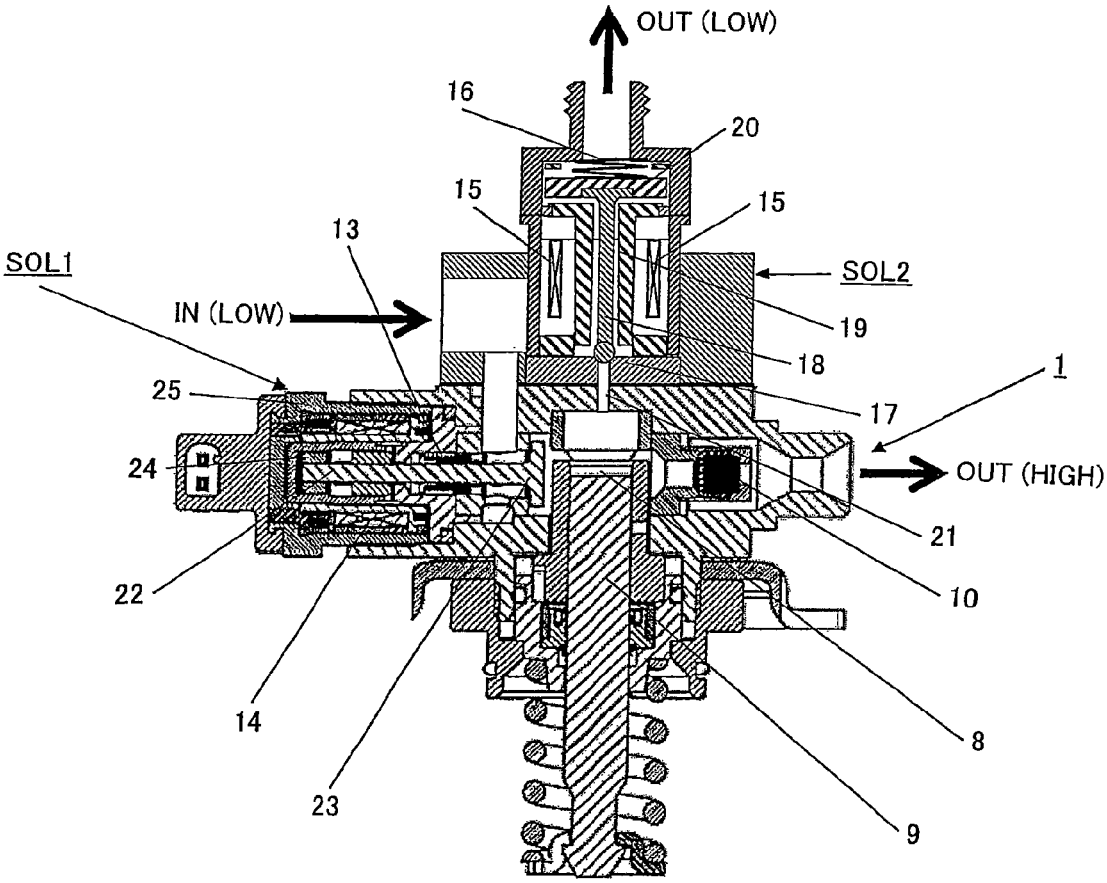
FIG. 3 shows a schematic drawing of an example of a high-pressure fuel supply pump according to the first embodiment of the present invention.

The high-pressure fuel supply pump according to the first embodiment of the present invention is shown in FIG. 3 and comprises the compression chamber 8, the plunger 9 reciprocating in the compression chamber 8 for pressurizing fuel in the compression chamber 8, the discharge valve 10 for discharging pressurized fuel from the compression chamber 8 to the high-pressure fuel passage 11 of the high-pressure fuel supply system for supplying high-pressure fuel to the internal combustion engine, and the first solenoid actuated valve SOL1 for connecting and disconnecting the first low-pressure fuel passage 3 and the compression chamber 8. The first solenoid actuated valve SOL1 is biased by a spring 13 in a closing direction of the first solenoid actuated valve SOL1, and the first solenoid actuated valve SOL 1 is opened or kept open against the biasing force of the spring 13, when the solenoid of the first solenoid actuated valve SOL1 is energized, i.e. when current is applied to the coil 14 of the first solenoid actuated valve SOL 1. This means that SOL 1 is a "normally closed" solenoid actuated valve.

The high-pressure fuel supply pump 1 further comprises the second solenoid actuated valve SOL2 for connecting and disconnecting the second low-pressure fuel passage 4 and the compression chamber 8. The second solenoid actuated valve SOL 2 is a "normally open" solenoid actuated valve which is configured to be closed, when the second solenoid actuated valve is energized, i.e. when a current is applied to the coil 15 of the second solenoid actuated valve SOL 2.

Figure 4:
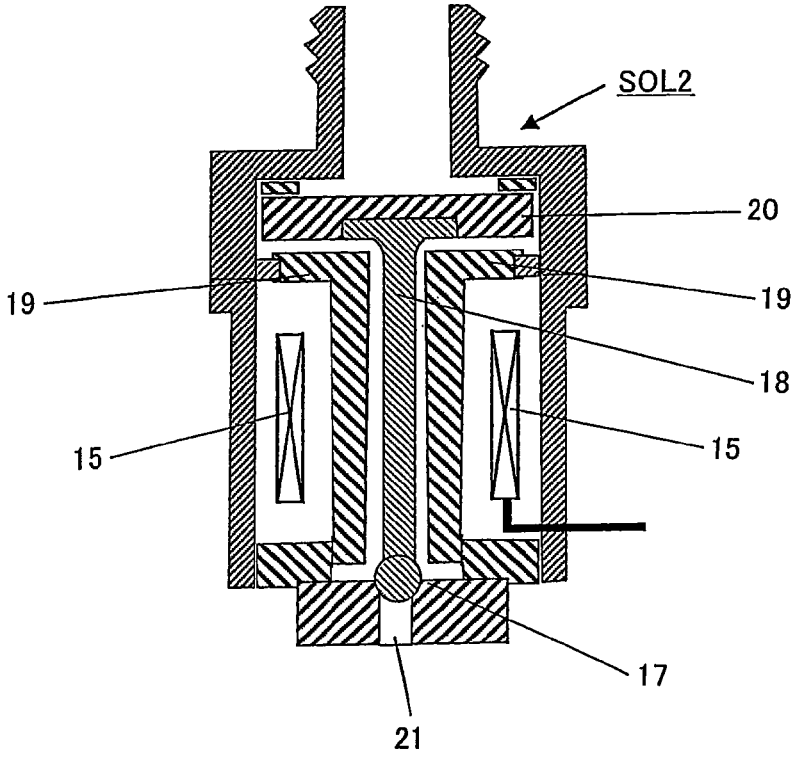
FIG. 4 shows a schematic drawing of an example of a second solenoid actuated valve of a high-pressure fuel supply pump according to the first embodiment of the present invention.

According to the first embodiment, it is possible to provide the second solenoid actuated valve SOL 2 having no biasing member such as a spring provided for biasing the second solenoid actuated valve SOL 2 in the direction of opening the valve since the valve can be opened or be kept open by hydraulic force when being deenergized as is shown with reference to the example of a push type second solenoid actuated valve SOL2 as shown in FIG. 4. Alternatively, as shown in FIG. 3, a spring 16 can be provided acting a biasing force in the closing direction of the second solenoid actuated valve SOL2 which is smaller than the hydraulic force during an upward stroke of the plunger such that the second solenoid actuated valve SOL2 can be opened by hydraulic force when being deenergized. However, the present invention is not limited to this and the first embodiment may be further modified by providing a biasing member such as a spring acting in the direction of opening the second solenoid actuated valve SOL2 such that the second solenoid actuated valve SOL2 is biased by this spring in an opening direction of the second solenoid actuated valve SOL2, wherein the second solenoid actuated valve SOL2 is then configured to be closed against the force of this spring, when the second solenoid actuated valve SOL2 is energized.

The second solenoid actuated valve SOL2 according to the first embodiment of the present invention is a push-type valve as shown with reference to the examples of FIG. 3 (SOL2 having a spring 16) and FIG. 4 (SOL2 having no spring), which comprises a valve seat 17, and a push rod 18 for coming in contact with the valve seat 17 for closing the valve, when the second solenoid actuated valve SOL2 is energized, i.e. when a current is applied to the coil 15, wherein the push rod 18 is then pushed by electromagnetic force until the push rod 18 comes in contact with the valve seat 17 so that the valve is closed or kept closed by means of the magnetic force. The second solenoid actuated valve SOL2 in FIGS. 3 and 4 has a core 19 and an anchor 20 (which can be fixed to the push rod as shown in FIGS. 2 and 3 or also be formed separately). When current is applied to the coil 15, the anchor 20 and the core 19 are attracted to each other by magnetic force and the push rod 18 is pushed in the direction of the valve seat 17 for closing the valve and/or keeping the valve closed as long as a current is applied to the coil 15. More precisely, when the solenoid of the second solenoid actuated valve SOL2 is energized, the magnetic force pushes the push rod 18 to close the small passage 21 of the second solenoid actuated valve SOL2, which small passage 21 is connected to the compression chamber 8 of the high-pressure fuel supply pump.

This means that the push rod 18 is pressed onto the valve seat 17 for closing the valve SOL2, when the solenoid of SOL2 is energized. In this configuration, it is possible to compress the fuel in the compression chamber 8 only, when SOL2 is switched on and the second solenoid actuated valve SOL2 is closed and kept closed. When the second solenoid actuated valve SOL2 is not switched on, i.e. when there is no current applied to the coil 15, the push rod 18 can be pushed away from the valve seat 17 by hydraulic force in the example of FIG. 4 and, according to the example of FIG. 3, the push rod 18 can be pushed away from the valve seat 17 by means of the provided spring 16 and/or hydraulic force.

Consequently, when there is no current applied to the solenoid of the second solenoid actuated valve SOL2, i.e. when SOL2 is switched off, it is not possible to compress the fuel inside the compression chamber 8 since the fuel will be spilled out via the second solenoid actuated valve SOL2. Namely, in the example of FIG. 3, the push rod 18 is pushed by hydraulic force from the valve seat 17 to open the valve and/or keep the valve open against the biasing force of spring 16 (i.e. the biasing force of spring 16 is smaller than the hydraulic force), when the second solenoid actuated valve SOL2 is deenergized, i.e. when there is no current applied to the coil 15, and, in the example of FIG. 4, the push rod 18 can be pushed by hydraulic force from the valve seat 17 to open the valve and/or keep the valve open, when the second solenoid actuated valve SOL2 is deenergized, i.e. when there is no current applied to the coil 15.

Furthermore, as shown with reference to the example of FIG. 4, the anchor 20 and/or the core 19 can be provided so as to have a larger diameter than the inner diameter of the coil 15, e.g. by extending the core 19 e.g. by overhanging the core 19 outside the diameter of the coil 15. With such a construction, the solenoid of the second solenoid actuated valve SOL2 can be provided which has a strong magnetic force, with only a small drive current, realized in a very compact body size.

It is to be noted that FIG. 4 only shows an example of the second solenoid actuated valve SOL2 having no biasing member, whereas FIG. 3 shows the whole high-pressure fuel supply pump according to the first embodiment having a second solenoid actuated valve SOL2 having spring 16 as a biasing member. Of course, the high-pressure fuel supply pump can be provided having a second solenoid actuated valve SOL2 having no biasing member by replacing the exemplary second solenoid actuated valve SOL2 of FIG. 3 with the exemplary second solenoid actuated valve SOL2 of FIG. 4.

Second Embodiment

The high-pressure fuel supply pump in a fuel supply system according to a second embodiment of the present invention only differs from the fuel pump of the first embodiment in that the second solenoid actuated valve SOL2 is a pull type valve as will be described below. However, regarding the remaining features, the high-pressure fuel supply pump according to the second embodiment of the present invention also comprises the compression chamber 8, the plunger 9 reciprocating in the compression chamber 8 for pressurizing fuel in the compression chamber 8, the discharge valve 10 for discharging pressurized fuel from the compression chamber 8 to the high-pressure fuel passage 11 for supplying high-pressure fuel to the internal combustion engine, and the first solenoid actuated valve SOL1 for connecting and disconnecting the first low-pressure fuel passage 3 and the compression chamber 8 as already described in detail above with reference to FIG. 1 and FIG. 2.

Figure 5:
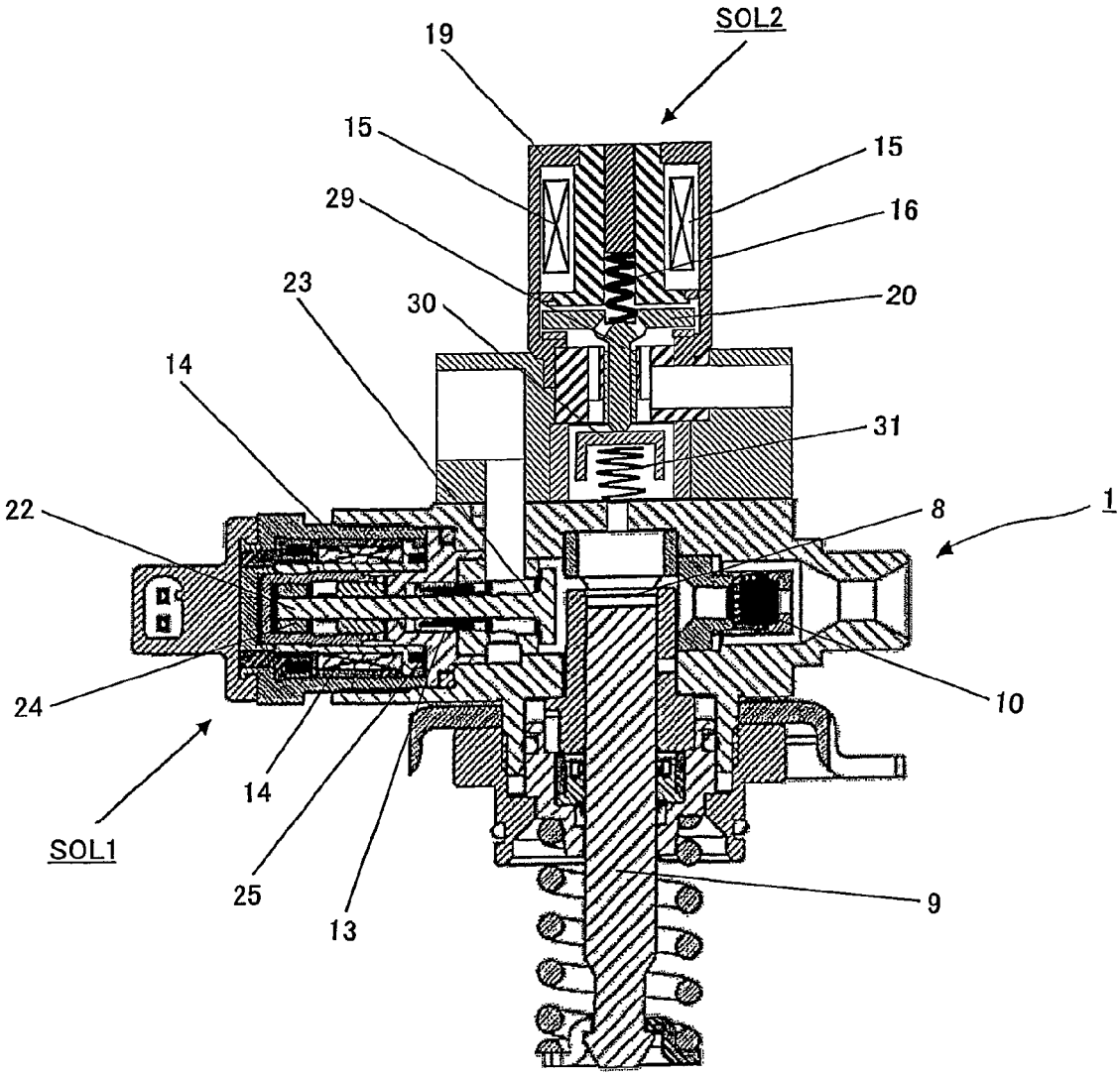
FIG. 5 shows a schematic drawing of an example of a high-pressure fuel supply pump according to the second embodiment of the present invention.

An example of a high-pressure fuel supply pump according this second embodiment of the present invention is shown in FIG. 5 and comprises a pull type valve as the second solenoid actuated valve SOL2 for connecting and disconnecting the second low-pressure fuel passage 4 and the compression chamber 8. Still, according to the concept of the invention, the second solenoid actuated valve SOL2 is configured to be closed, when the second solenoid actuated valve SOL2 is energized.

According to this embodiment, the second solenoid actuated valve SOL2 is a pull-type valve, which comprises a valve seat 17, a valve body 30 for coming in contact with the valve seat 17 for closing the valve, where the valve body 30 is biased by a spring 31 in the direction of closing the valve, and a pull rod 29 for coming in contact with the valve body 30. The pull rod 29 is biased by the biasing force of the spring 16 in the direction of opening the valve so that the valve can be opened or kept open against the biasing force of the spring 31, when the second solenoid actuated valve SOL1 is deenergized. Accordingly, the biasing force of the spring 16 is larger than the biasing force of the spring 31. Furthermore, the pull rod 29 is pulled from the valve body 30 by magnetic force against the biasing force of the spring 16 so that the second solenoid actuated valve SOL is closed by the biasing force of the spring 31 in that the valve body 30 is pressed onto the valve seat 17, when the second solenoid actuated valve SOL2 is energized.

In other words, the pull rod 29 of the second solenoid actuated valve SOL2 is pulled away from the valve body 30 by magnetic force in that the anchor 20 and the core 19 are attracted to each other, when the solenoid is energized, i.e. when current is applied to coil 15, against the strong biasing force of the spring 16. However, when there is no current applied to the coil 15, the strong biasing force of the spring 16 biases the push rod in the direction of the valve body (in direction of opening the valve) and tends to push the valve body 30 to the open position away from the valve seat 17 against the biasing force of the spring 31 which biases the valve body 30 in the direction of closing the valve. Again, when the second solenoid actuated valve SOL2 is switched on by applying current to the coil 15, the pull rod 29 will be pulled back by means of magnetic force so that the spring 31 can displace the valve body 30 for bringing the valve body 30 in contact with the valve seat 17 so as to close the valve. Then, the fuel inside the compression chamber 8 can be compressed/pressurized in an upward stroke of the plunger 9 in the compression chamber 8. However, when the second solenoid actuated valve SOL2 is switched off, the pull rod 29 pushes the valve body 30 in the opening direction for opening the valve so as to prevent the fuel inside the compression chamber 8 to be compressed in an upward stroke of the plunger 9 by allowing fuel to be spilled out of the compression chamber.

Figure 6B:
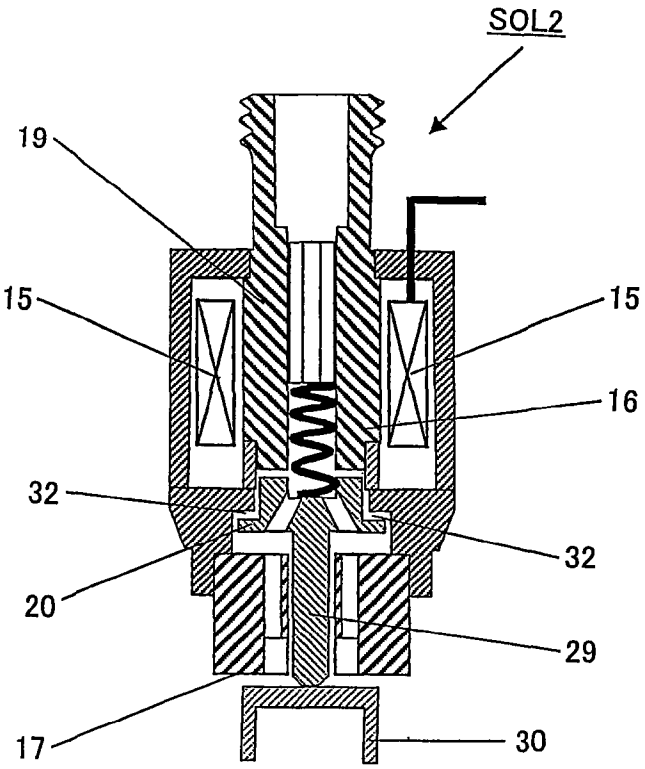
FIGS. 6A and 6B show schematic drawings of examples of second solenoid actuated valves of a high-pressure fuel supply pump according to the second embodiment of the present invention.
Figure 6A:
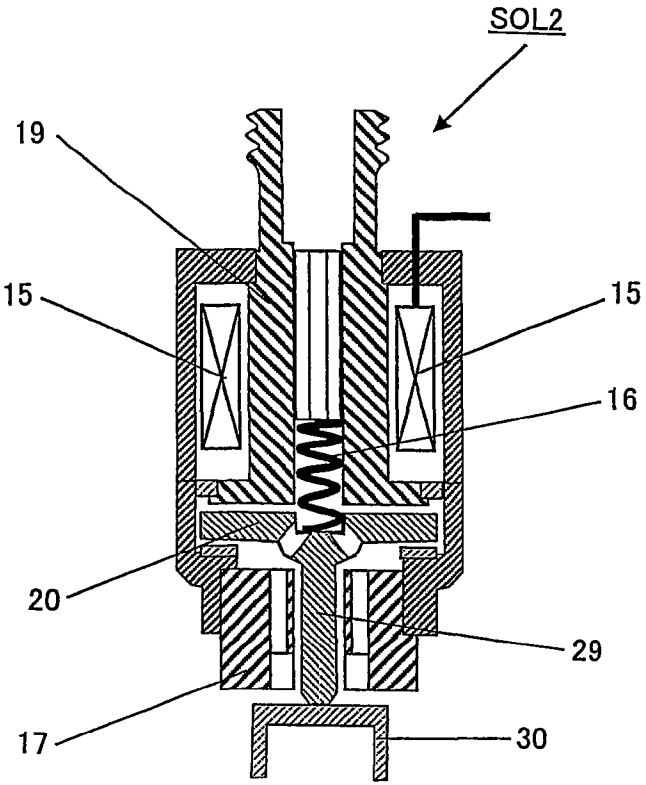

Further structural examples of a pull-type second solenoid actuated valve SOL2 according to the second embodiment are illustrated in FIGS. 6A and 6B. For example, FIG. 6A shows a solenoid having a structure according to which the diameter of the anchor 20 and the core 19 are larger than inner diameter of the coil 15 (i.e. using a similar concept as described with reference to a push type valve in FIG. 4) for generating a strong magnetic force in a small compact structure already at less drive current of the solenoid. FIG. 6B shows another example of the second solenoid actuated valve SOL2 of a pull-type which also enables to produce a strong magnetic force with a small drive current in a compact structure. According to this structure, a second air gap 32 is provided in addition to a first air gap between the anchor 20 and the core 19, wherein the second air gap 32 providing a larger attraction area in total. This construction as shown in FIG. 6B also enables the solenoid to generate a stronger magnetic force at a small drive current in a compact structure.

Third Embodiment

The fuel supply system according to a third embodiment of the present invention differs from the fuel supply systems as described with reference to the first embodiment and the second embodiment in that the second solenoid actuated valve SOL2 not included in the high-pressure fuel supply pump but is provided for connecting/disconnecting the high-pressure fuel supply system and the low-pressure fuel supply systems by e.g. connecting/disconnecting one of the high-pressure fuel passage 11 and the high-pressure fuel rail 12 with one of the first or second low-pressure fuel passages 3 and 4, the low-pressure main passage 5, and the low-pressure fuel rail. In the following, a preferable configuration for the third embodiment will be described with reference to FIG. 7, which shows a fuel supply system where the second solenoid actuated valve SOL2 provided for connecting/disconnecting the high-pressure fuel rail 12 with the low-pressure main passage 5.

The fuel systems according to all of the above-mentioned embodiments (e.g. FIG. 1 and FIG. 7) comprise the high-pressure fuel supply system for supplying high-pressure fuel to the internal combustion engine, the high-pressure fuel supply pump 1 for pressurizing fuel and delivering pressurized fuel to the high-pressure fuel supply system, and the low-pressure fuel supply system for delivering low-pressure fuel to the high-pressure fuel supply pump 1. The high-pressure fuel supply pump 1 has the "normally closed" type first solenoid actuated valve SOL1 which is opened and/or kept open against the biasing force of a spring 13, when current is applied to the coil 14 of the first solenoid actuated valve SOL1. Additionally, the "normally open" type second solenoid actuated valve SOL2 is provided for connecting and disconnecting the low-pressure fuel main passage 5 of the low-pressure fuel supply system and the compression chamber 8 of the high-pressure fuel supply pump 1 as shown in FIG. 1 (first and second embodiment) or alternatively for connecting and disconnecting the low-pressure fuel main passage 5 of said low-pressure fuel supply system and the high-pressure fuel rail 12 of the high-pressure fuel system. This means that according to the first and second embodiments as described above, the second solenoid actuated valve SOL2 is comprised in the high-pressure fuel supply pump 1, whereas according to this third embodiment, the second solenoid actuated valve SOL2 is configured to connect and disconnect the high-pressure fuel rail 6 of the high-pressure fuel supply system and the low-pressure fuel main passage 5 of the low-pressure fuel supply system.

Figure 7:
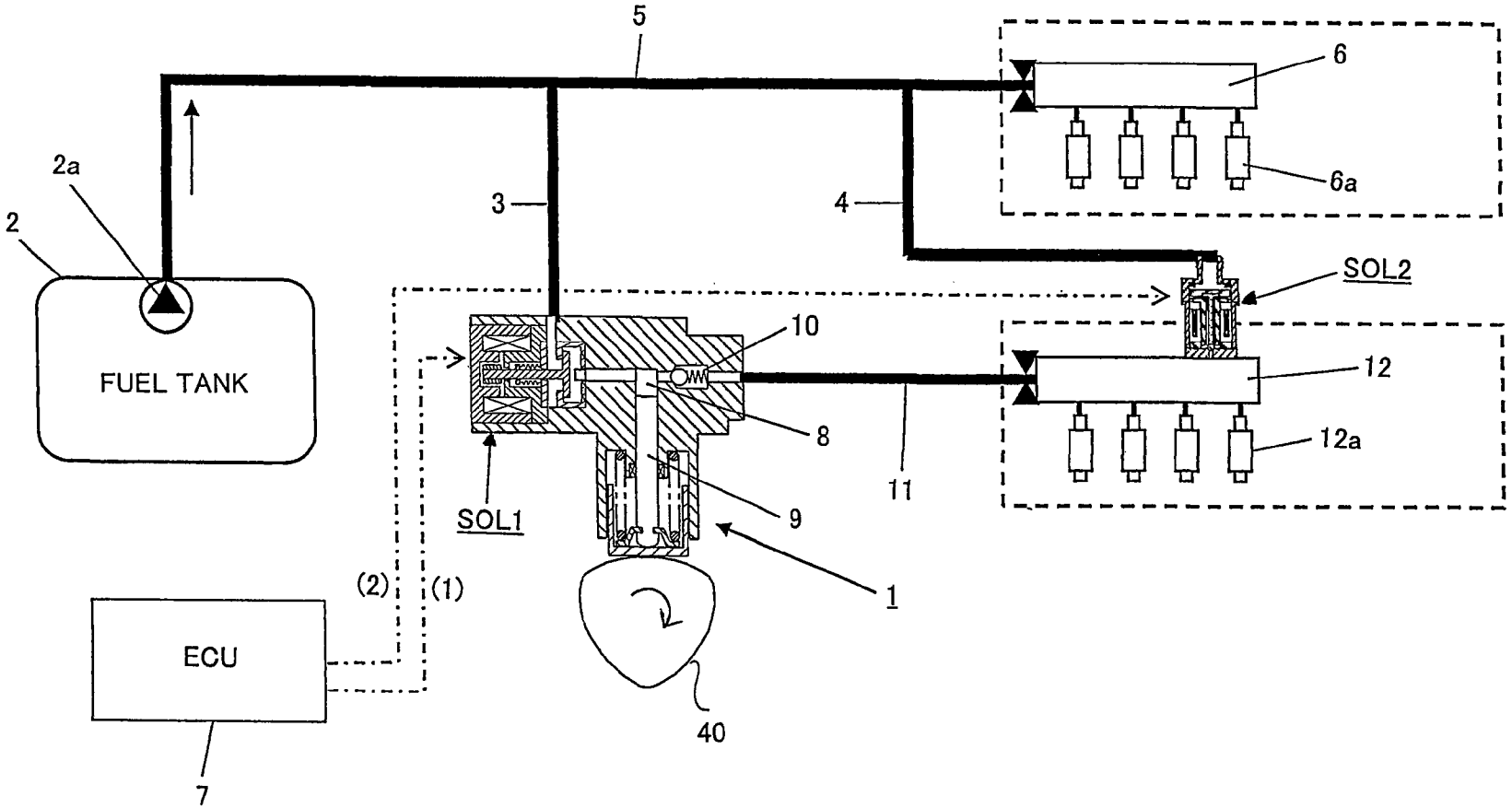
FIG. 7 shows a schematic drawing of a high-pressure fuel supply pump and a corresponding fuel supply system according to an example of the third embodiment of the present invention.

According to the configuration according to the third embodiment, the "normally open" second solenoid actuated valve SOL2 is mounted on the high-pressure fuel rail as shown in FIG. 7, where the second solenoid actuated valve SOL2 is a push-type valve, similar to the structure as described with reference to the exemplary push-type valves of FIGS. 3 and 4. In FIG. 7, the fuel inside the high-pressure fuel passage 11 and the high-pressure fuel rail 12 can be compressed (or, in other words, high-pressure fuel can be delivered to the high-pressure fuel system at high-pressure) when the second solenoid actuated valve SOL2 is switched on, i.e. when current is applied to the coil 15, so that the second solenoid actuated valve SOL2 is kept closed. However, when the second solenoid actuated valve SOL2 is not switched on, i.e. when no current is applied to the coil 15, the push rod 18 will be apart from the seal seat 17 so that the valve is open so as to release the fuel from the high-pressure fuel rail 12 to the low-pressure system, in particular, to the low-pressure fuel main passage 5. Since the fuel is not highly compressed (or, in other words, is delivered to the high-pressure fuel system via the discharge valve 10 but not at high-pressure), when the second solenoid actuated valve SOL2 is open, there does not occur any compression loss in the pump driving energy. Moreover, recirculation of fresh fuel will advantageously occur within the fuel supply system between the high-pressure fuel supply pump 1, the high-pressure fuel passage 11, the high-pressure fuel rail 12, and the low-pressure passages 3, 4, and 5 of the low-pressure fuel system, which prevents deterioration of fuel and further enables the high-pressure fuel system to be cooled down even during low-pressure fuel supply mode such as PFI mode. An additional benefit of this configuration is that the direct injectors 12*a* will be in turn also cooled down, which is beneficial to reduce deposits on the injectors 12*a*. A yet further advantage of the structure of this third embodiment as shown in FIG. 7 during PFI mode is that a pressure pulsation at the low pressure-fuel rail 6 which might be caused by the movement of the plunger 9 can be reduced compared to the configuration of FIG. 1 because the fuel passes through the high-pressure fuel rail 12 which leads to the advantageous effect that the large volume of fuel functions so as to dampen the pulsation.

Figure 8:
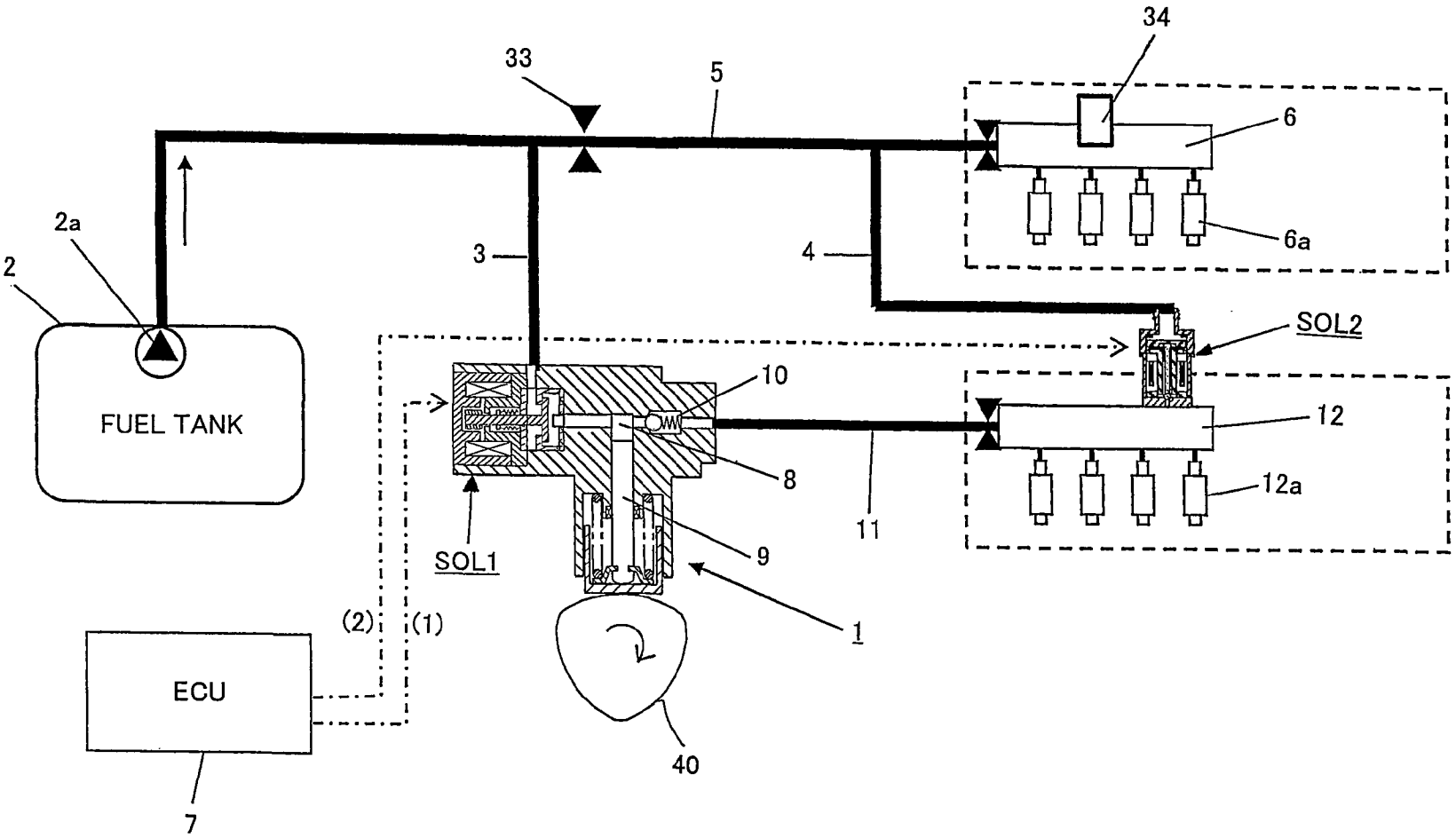
FIG. 8 shows a schematic drawing of a high-pressure fuel supply pump and a corresponding fuel supply system according to another example of the third embodiment of the present invention.

It is further possible to modify the above-described structure of the fuel supply system of FIG. 7 by additionally providing a flow-rate reducing means for reducing a flow-rate of fuel from the second low-pressure fuel passage 4 to the first low-pressure fuel passage 3, if the pressure of fuel in the second low-pressure fuel passage 4 is larger than the pressure of fuel in said first low-pressure fuel passage 3 such as for example an orifice 33 in the low-pressure fuel system such as in the low-pressure fuel main passage 5 between the first and second low-pressure fuel passages 3 and 4 for reducing the back-propagation (or back-flow) of the pressure pulsations from the high-pressure fuel rail through the second solenoid actuated valve SOL2 as shown in FIG. 8, when the second solenoid actuated valve is open.

It is yet further possible to modify the above-described structure of the fuel supply system having the orifice 33 by additionally providing a pressure sensor 34 for determining a pressure of low-pressure fuel in the low-pressure fuel rail 6 as further shown in FIG. 8. The orifice 33 is provided in the low-pressure main passage 5 between the first and second low-pressure fuel passages 3 and 4, and, in addition thereto, the pressure sensor 34 is provided in the low-pressure fuel rail 6. In such a configuration, also in the low-pressure fuel supply mode such as PFI mode, the fuel pressure in the low-pressure fuel rail 6 can be increased compared to the pressure of the fuel in the low-pressure system downstream of the orifice 33 as provided by the low-pressure pump from the fuel tank 2 by controlling the recirculation of fuel flow from the high-pressure fuel rail 12 using the high-pressure fuel pump 1 and the second solenoid actuated valve SOL2. The operation of the high-pressure fuel pump 1 and the second solenoid actuated valve SOL2 can be controlled based on the pressure measured with the pressure sensor 34. The pressure sensor also can be provided on the high-pressure fuel rail. So, the second solenoid actuated valve SOL2 can be released when the fuel pressure in the high-pressure fuel rail 12 sensed by the pressure sensor become higher than the predetermined value. This modified embodiment of the present invention can be beneficial to provide a higher fuel pressure for the injectors 6*a*, e.g. for improved atomization characteristics. It is also possible to reduce the feed pressure of the fuel provided by the low-pressure fuel pump to save electrical energy consumption in the operation of the low-pressure pump supplying fuel from the tank 2 to the low-pressure fuel system, and, then, subsequently boosting (increasing) the fuel pressure of fuel supplied to the injectors 6*a* in the low-pressure fuel supply mode such as PFI injectors in PFI mode.

Of course, such an orifice 33 may also be provided between the first and second low-fuel passages 3 and 4 for modifying any of the first and second embodiment e.g. according to FIG. 1. In particular, it is to be noted that single structural and/or functional aspects and features as described above with reference to the first, second, and third embodiments of the present invention may be combined in any way, partly or as a whole, and such modifications shall be contained within the scope of disclosure of the present description, and a detailed description of every possible combination is omitted for reasons of conciseness of the present description.

(Configuration of the Internal Combustion Engine)

It is to be noted that the fuel supply systems according to the above described embodiments have been described as exemplary embodiments, especially regarding the configuration of the internal combustion engine. For example, in FIGS. 1, 7, and 8, there are provided one low-pressure fuel rail 6 having four injector means 6*a* and one high-pressure fuel rail 12 having four direct injector means 12*a* so that an internal combustion engine of a four-cylinder configuration is implied in these figures. However, the present invention is not limited to hybrid fuel supply systems for supplying high-pressure fuel and low-pressure fuel to an internal combustion engine of a four-cylinder configuration, and further embodiments of fuel supply systems according to the present invention can be provided for various internal combustion engine configurations, including at least the following:

a 3-cylinder internal combustion engine (in-line configuration), i.e. a fuel supply system comprising one low-pressure fuel rail having three low-pressure fuel injector means and one high-pressure fuel rail having three direct injector means;

a 5-cylinder internal combustion engine (in-line configuration), i.e. a fuel supply system comprising one low-pressure fuel rail having five low-pressure fuel injector means and one high-pressure fuel rail having five direct injector means;

a 6-cylinder internal combustion engine (in-line configuration), i.e. a fuel supply system comprising one low-pressure fuel rail having six low-pressure fuel injector means and one high-pressure fuel rail having six direct injector means;

a V6, V8, V10, or V12 internal combustion engine, and a fuel supply system having one high-pressure fuel supply pump and comprising two low-pressure fuel rails each having three, four, five, or six low-pressure fuel injector means and two high-pressure fuel rails each having three, four, five, or six direct injector means, both high-pressure fuel rails being supplied from the high-pressure fuel supply pump;

a V6, V8, V10, V12 internal combustion engine, and a fuel supply system having two or more high-pressure fuel supply pumps and comprising two or more low-pressure fuel rails each having the respective number of low-pressure fuel injector means and two or more high-pressure fuel rails each having the respective number of direct injector means, where the high-pressure fuel rails are supplied from the two or more high-pressure fuel supply pumps;

a W12 or W16 internal combustion engine, the fuel supply system sharing one or more high-pressure fuel supply pumps with four high-pressure GDI PFI fuel rails; and generally any internal combustion engine, which may be operated in PFI and/or GDI mode, wherein the fuel supply system comprises one or more high pressure fuel supply pumps, one or more low-pressure fuel rails each comprising one or more low-pressure fuel injector means, and one or more high-pressure fuel rails each having one or more direct injector means, where the high-pressure fuel rails are supplied from the one or more high-pressure fuel supply pumps.

It is to be noted that fuel supply systems of the configurations mentioned above having two or more high-pressure fuel supply pumps may combine one or more high-pressure fuel supply pumps as discussed with reference to the first and second embodiments and one or more high-pressure fuel supply pumps as discussed with reference to the third embodiment. Furthermore, it is to be noted that one or more additional pressure sensor means can be provided in the high-pressure fuel system (e.g. in the high-pressure fuel rail or high pressure fuel rails) for determining a pressure of high-pressure fuel in the high-pressure fuel system (e.g. in the high-pressure fuel rail or high pressure fuel rails) to enable closed-loop high-pressure control of the fuel supply system via the ECU 7 by controlling the fuel supply system, and in particular the high-pressure fuel supply pumps, based on the output of the pressure sensor means in the high-pressure fuel supply system.

(Modes of Operation)

In the following, various possible different modes of operation of the high-pressure fuel supply pump according to the above described embodiments of the present invention and/or of the fuel supply system according to the above described embodiments of the present invention will be described in detail. These modes of operation correspond to different methods which are possible for controlling the high-pressure fuel supply pump according to the above described embodiments of the present invention and/or of the fuel supply system according to the above described embodiments of the present invention, especially for controlling the first solenoid actuated valve SOL1 and/or the second solenoid actuated valve SOL2 so as to control the supply of low-pressure fuel in a low-pressure fuel supply mode such as a PFI mode with PFI injection to an intake air passage of the internal combustion engine or the supply of high-pressure fuel in a high-pressure fuel supply mode such as GDI mode or SIDI mode with GDI injection to the cylinders of the internal combustion engine.

The various possible different modes of operation of the high-pressure fuel supply pump according to the above described embodiments of the present invention and/or of the fuel supply system according to the above described embodiments of the present invention will be described with reference to the remaining figures. In these figures, reference is made to a movement of the plunger 9 in the compression chamber 8 (also referred to as lift of the plunger 9). The y-axis direction denotes an oscillatory movement of the plunger 9 as a function of time (in the x-axis direction) where the plunger 9 moves upward in the compression chamber 8, during an upward stroke of the plunger 9, for decreasing the volume of the compression chamber 8 for pressurizing fuel inside the compression chamber 8 to be discharged via the discharge valve 10 or spilling out fuel from the compression chamber 8 via the inlet/chamber/spill valve(s) SOL1 and/or SOL2 depending on the control state of the inlet/chamber/spill valve(s) SOL1 and/or SOL2, until the plunger 9 reaches a so-called "Top Dead Center" position labeled as TDC in the figures. Thereafter, the plunger 9 starts its intake stroke and, during the intake stroke of the plunger 9, the plunger 9 moves downward in the compression chamber 8 for increasing the volume of the compression chamber 8 for drawing fuel into the compression chamber 8, until the plunger 9 reaches a so-called "Bottom Dead Center" position labeled as BDC in the figures. Thereafter, the plunger 9 starts its upward stroke again and, during the upward stroke of the plunger 9, moves upward again in the compression chamber 8. Accordingly, as a function of time, the movement of the plunger 9 can be illustrated as a sine function.

Furthermore, in the remaining figures, the control signals according to the various possible different control operations of the first and second solenoid actuated valves SOL1 and/or SOL2 are illustrated as a step function of time (in the x-axis direction) indicating, whether voltage is applied to the coils or not, i.e. whether the control signal is ON or OFF. Also, the corresponding motion of the first and second solenoid actuated valves SOL1 and/or SOL2 are illustrated as a function of time (in the x-axis direction)

It should be noted that there is an order of magnitude difference in the amount of electrical energy required for controlling the "normally open" type second solenoid actuated valve SOL2 (push-type and pull-type) and the "normally closed" type first solenoid actuated valve SOL1 (with the latter requiring much less electrical energy). Furthermore, the operation of the "normally closed" type first solenoid actuated valve SOL1 yields significantly quieter noise levels and significantly reduced vibrations.

Control of the fuel supply system naturally involves the control of both solenoid actuated valves SOL1 and SOL2. For each solenoid actuated valve, the resulting combination of the biasing force of the spring/springs and occurring hydraulic forces determines the position of the valve, when there is no current applied to the coils, and hence fuel flow through the respective valves into and/or from the compression chamber depends on the resultant non-electromagnetic forces. Of course, when current is applied to the coils, the resultant force includes the magnetic force and generally, the first solenoid actuated valve SOL1 is opened and/or kept open, when current is applied to the coil 14, and the second solenoid actuated valve SOL2 is closed and/or kept closed, when current is applied to the coil 15. Since the hydraulic forces play a very important role in the force balance of the resultant force, when there is no current applied to the coils, for both valves (due to the relatively large magnitude of the hydraulic force), the motion and operation of both solenoid actuated valves SOL1 and SOL2 simultaneously bears a crucial role in the performance of the high-pressure fuel supply pump and the fuel supply system. In turn, this means that at least the control of the first solenoid actuated valve SOL1 and preferably the control of both valves should be very precisely synchronized. A description of various modes of operations according to the present invention and the corresponding control of the valves SOL1 and SOL2 is given in the following.

(First Mode of Operation—Basic Operation Mode for Low-Pressure Fuel Supply)

Figure 9:
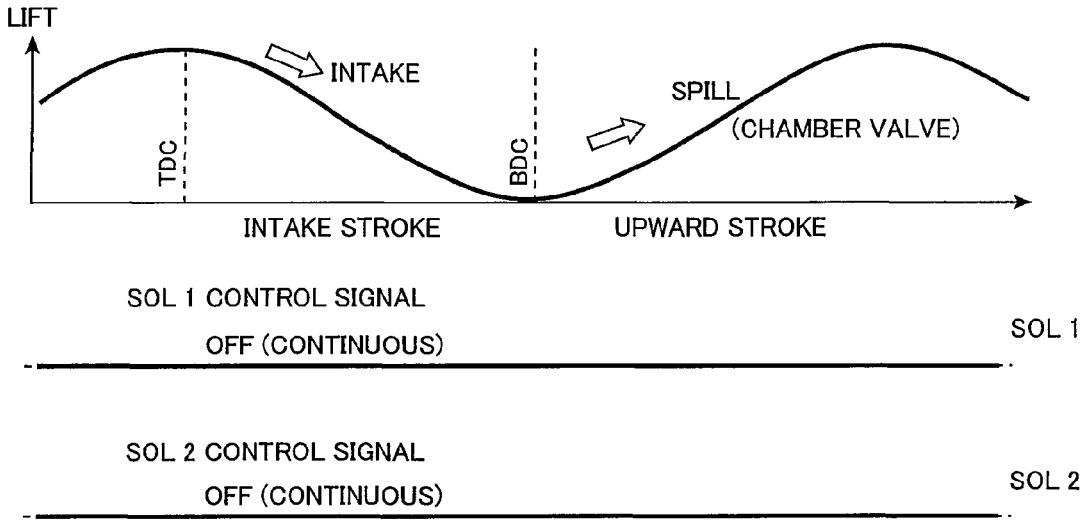
FIG. 9 shows a schematic drawing illustrating an example of a first mode of operation of the fuel system according to the present invention.

In the first mode of operation of the high-pressure fuel supply pump 1 or the fuel supply system as illustrated in FIG. 9, the first solenoid actuated valve SOL1 and the second solenoid actuated valve SOL2 are controlled such that low-pressure fuel is supplied to the internal combustion engine e.g. via the so-called PFI injection. This first mode of operation can be applied to all of the above-mentioned embodiments of the present invention, i.e. the high-pressure fuel supply pump 1 and the fuel supply system according to the first embodiment, the high-pressure fuel supply pump 1 and the fuel supply system according to the second embodiment, and the fuel supply system according to the third embodiment.

According to this first mode of operation, the internal combustion engine can be for example operated in the so-called PFI mode, i.e. low-pressure fuel is supplied to the internal combustion engine via the injector means 6*a* of the low-pressure fuel rail 6 of the low-pressure fuel supply system and no high-pressurized fuel is supplied via the high-pressure fuel system (i.e. there is no direct fuel injection at high pressure such as GDI injection in this first mode of operation).

In the first mode of operation, both solenoid actuated valves SOL1 and SOL2 are switched off/deenergized, i.e. the first solenoid actuated valve SOL1 and the second solenoid actuated valve SOL2 are both continuously kept deenergized, i.e. there is neither supplied current to the coil 14 of the first solenoid actuated valve SOL1 nor to the coil 15 of the second solenoid actuated valve SOL2. Accordingly, no fuel pressurization occurs in the compression chamber 8 in spite of the movement of the plunger 9 because fuel can be spilled out of the compression chamber 8 via the deenergized "normally open" second solenoid actuated valve SOL2 before any pressurization of fuel occurs in the compression chamber 8. Accordingly, there is no electrical energy required in this first mode of operation since there is no current applied at all as both solenoid actuated valves are continuously kept deenergized (continuous control signal: OFF) as shown in FIG. 9.

Hence, controlling the first solenoid actuated valve SOL1 and the second solenoid actuated valve SOL2 according to the first mode of operation provides a mode of operation in which the operation is very quiet and operation noise can be efficiently reduced. Furthermore, the first mode of operation provides a very efficient method for controlling the fuel supply system in a low-pressure fuel supply mode such as PFI injection mode at a minimal electrical energy requirement.

(Second Mode of Operation—Basic Operation Mode for High-Pressure Fuel Supply)

Figure 10:
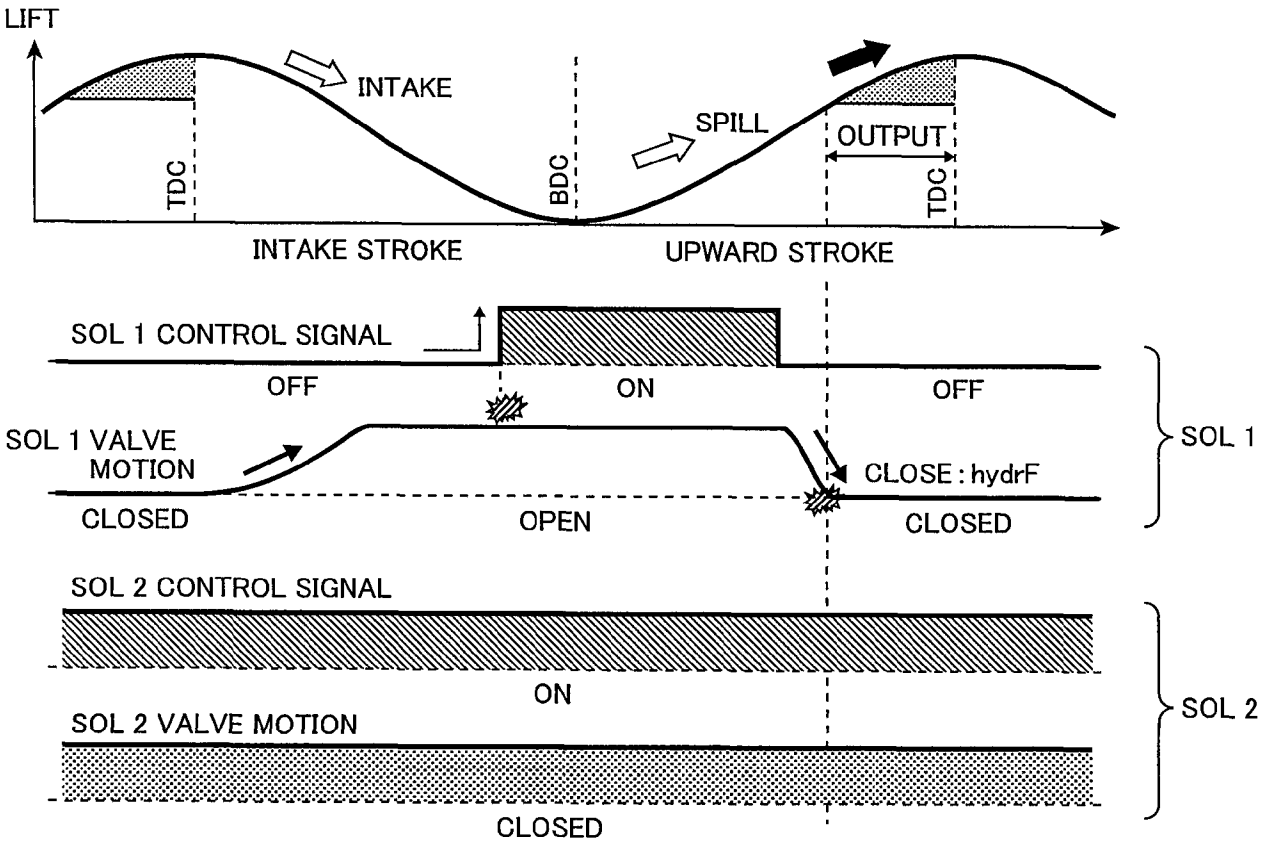
FIG. 10 shows a schematic drawing illustrating an example of a second mode of operation of the fuel system according to the present invention.

In a second operation mode of the high-pressure fuel supply pump 1 or the fuel system as illustrated in FIG. 10, the high-pressure fuel supply pump 1 or the fuel system is controlled for supplying high-pressure fuel to the internal combustion engine in that the second solenoid actuated valve SOL2 is continuously kept energized so as to be kept closed by magnetic force, i.e. current is continuously applied to the coil 15 of the second solenoid actuated valve SOL2, wherein the first solenoid actuated valve SOL1 is opened or kept open by hydraulic force during the intake stroke of the plunger 9 before energizing the solenoid of the first solenoid actuated valve SOL1 so as to function as an inlet valve for delivering low-pressure fuel into the compression chamber 8 during an intake stroke of the plunger 9. Thereafter, the first solenoid actuated valve SOL1 is energized (control signal ON) to be further opened or further kept open by magnetic force (or by hydraulic force and magnetic force) at least during part of the upward stroke of the plunger 9 so as to function as a spill valve for spilling low-pressure fuel out of the compression chamber 8 during part of the upward stroke of the plunger 9. Then, still during the upward stroke of the plunger 9, the first solenoid actuated valve SOL1 is deenergized (control signal: OFF) for closing the first solenoid actuated valve SOL1 during the upward stroke of the plunger 9 by hydraulic force so that fuel in the compression chamber 8 is pressurized to be delivered at high pressure to the high-pressure fuel supply system through the discharge valve 10.

In other words, the second solenoid actuated valve SOL2 is energized continuously by continuously applying current to the coil 15, thereby forcing the valve SOL2 to remain in a closed position, i.e. in the closed state. Accordingly, the high-pressure fuel supply pumps can work using the "normally closed" solenoid actuated valve SOL1 as an inlet valve according to the high-pressure fuel pump of EP 1 812 704 A1. The solenoid actuated valve SOL1 work as inlet valve and is controlled to remains deenergized during the start of the intake stroke of the plunger 9. The suction force created by the downward motion of the plunger 9 during the intake stroke generates a sufficient amount of hydraulic force to open the inlet valve SOL1. At a time before the plunger 9 reaches the BDC position, the solenoid of the first solenoid actuated valve SOL1 is energized. The generated magnetic force causes the inlet valve SOL1 to extend to the fully-open position (when it is not opened up to the fully-open position by means of the hydraulic force) until its movement is restricted e.g. in that the core 25 and the anchor 24 come in contact (and thereby causing a noise at impact). The magnetic force keeps the inlet valve SOL1 in the fully open position even when the plunger 9 changes its direction of motion for moving upwards in the upward stroke of the plunger 9. Then, at a time which is precisely controlled by the engine control unit 7, the solenoid of the first solenoid actuated valve SOL1 is de-energized so that the hydraulic force caused by the compression of the fuel in the compression chamber 8 cause the solenoid actuated valve SOL1 to close immediately which, in turn, leads to a rapid pressurization rate of the fuel within the compression chamber 8 as fuel cannot spill out anymore via the solenoid actuated valve SOL1, the pressure exceeding the pressure of fuel in the high-pressure fuel supply system (e.g. in the high-pressure fuel passage 11) and, hence, the pressurized fuel is delivered from the compression chamber 8 via the discharge valve 10 to the high-pressure fuel rail. A noise caused by the slamming of the inlet valve SOL1 in the fully closed position after deenergization may occur and also a noise generated by the rapid fuel pressurization rate in the compression chamber 8.

According to this mode of operation, the amount of high-pressure fuel to be delivered during the upward stroke of the plunger 9 can be controlled by controlling the timing of deenergizing the solenoid of the first solenoid actuated valve SOL1 during the upward stroke of the plunger 9 (the later SOL1 is deenergized, the less fuel is delivered at high pressure to the high-pressure system).

This mode of operation provides an operation for supplying high-pressure fuel to the high-pressure fuel system for high-pressure fuel supply mode such as GDI mode. Further, this operation mode provides the advantage that there is no noise generated by the second solenoid actuated valve which is a "normally closed" solenoid actuated valve, whereas the commonly known GDI operation in hybrid systems is controlled via a noisy "normally open" solenoid actuated valve (cf. e.g. EP 1 812 704 A1). However, a slightly higher amount of electrical energy is required since the second solenoid actuated valve SOL2 is kept continually energized.

(Third Mode of Operation—Alternative Operation Mode for High-Pressure Fuel Supply)

Figure 11:
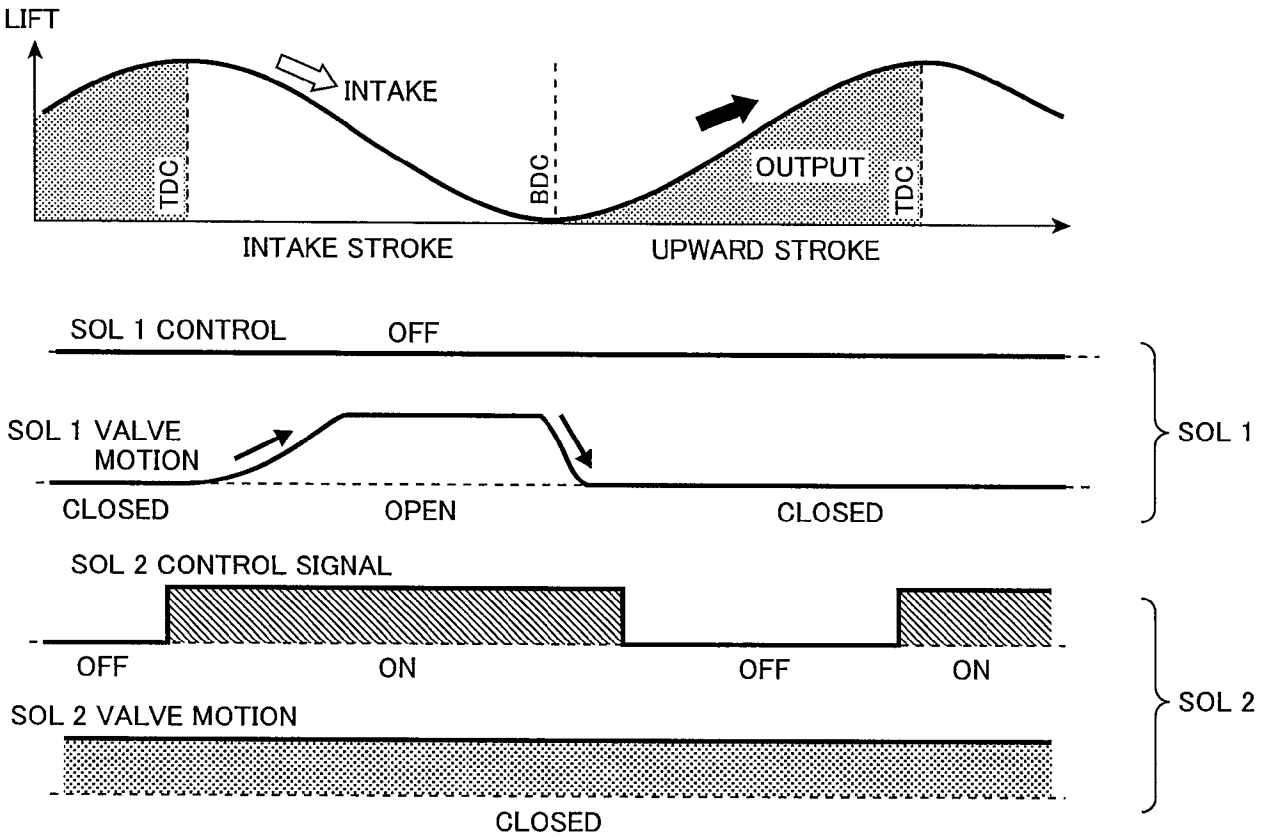
FIG. 11 shows a schematic drawing illustrating an example of a third mode of operation of the fuel system according to the present invention.

In a third operation mode of the high-pressure fuel supply pump 1 as illustrated in FIG. 11, the high-pressure fuel supply pump 1 is controlled such that the second solenoid actuated valve SOL2 is continuously kept closed, wherein the second solenoid actuated valve SOL2 is kept deenergized during an upward stroke of the plunger 9 so as to be kept closed by hydraulic force during the upward stroke of the plunger 9 and, wherein the second solenoid actuated valve SOL2 is kept energized from the end of the upward stroke, during an intake stroke, and until the beginning of a next upward stroke of the plunger 9 so as to be kept closed by magnetic force, wherein the first solenoid actuated valve SOL1 is operated similar to the mode of operation according to the above-described second mode of operation. It is to be noted that this third mode of operation is applicable to embodiments using a pull-type second solenoid actuated valve SOL2 so that the hydraulic force can be generated during an upward stroke of the plunger 9 such that it biases/presses the valve body 30 against the valve seat 17 during the upward stroke of the plunger 9. Still, similar to the second mode of operation, the second solenoid actuated valve SOL2 is continuously kept closed but not continuously by magnetic force but also by hydraulic force alone during at least part of the upward stroke of the plunger 9.

Compared to the basic control concept for high-pressure fuel supply mode such as GDI mode according to the second mode of operation, this mode of operation is more energy efficient as less electrical energy is required for continuously keeping the second solenoid actuated valve SOL2 continuously closed. However, it may be applicable only during a requirement of high amount fuel delivery, i.e. when the period of time in which the pressure in the compression chamber 8 is high (when both valves SOL1 and SOL2 are closed) is relatively long. Then, the period in which the second solenoid actuated valve SOL2 can be de-energized without any risk (i.e. the risk of opening the second solenoid actuated valve SOL2) since the hydraulic force will oppose the spring force for keeping the solenoid actuated valve SOL2 closed is relatively long.

(Fourth Mode of Operation—Relief Function Mode and/or Synchronization Mode)

Figure 12:
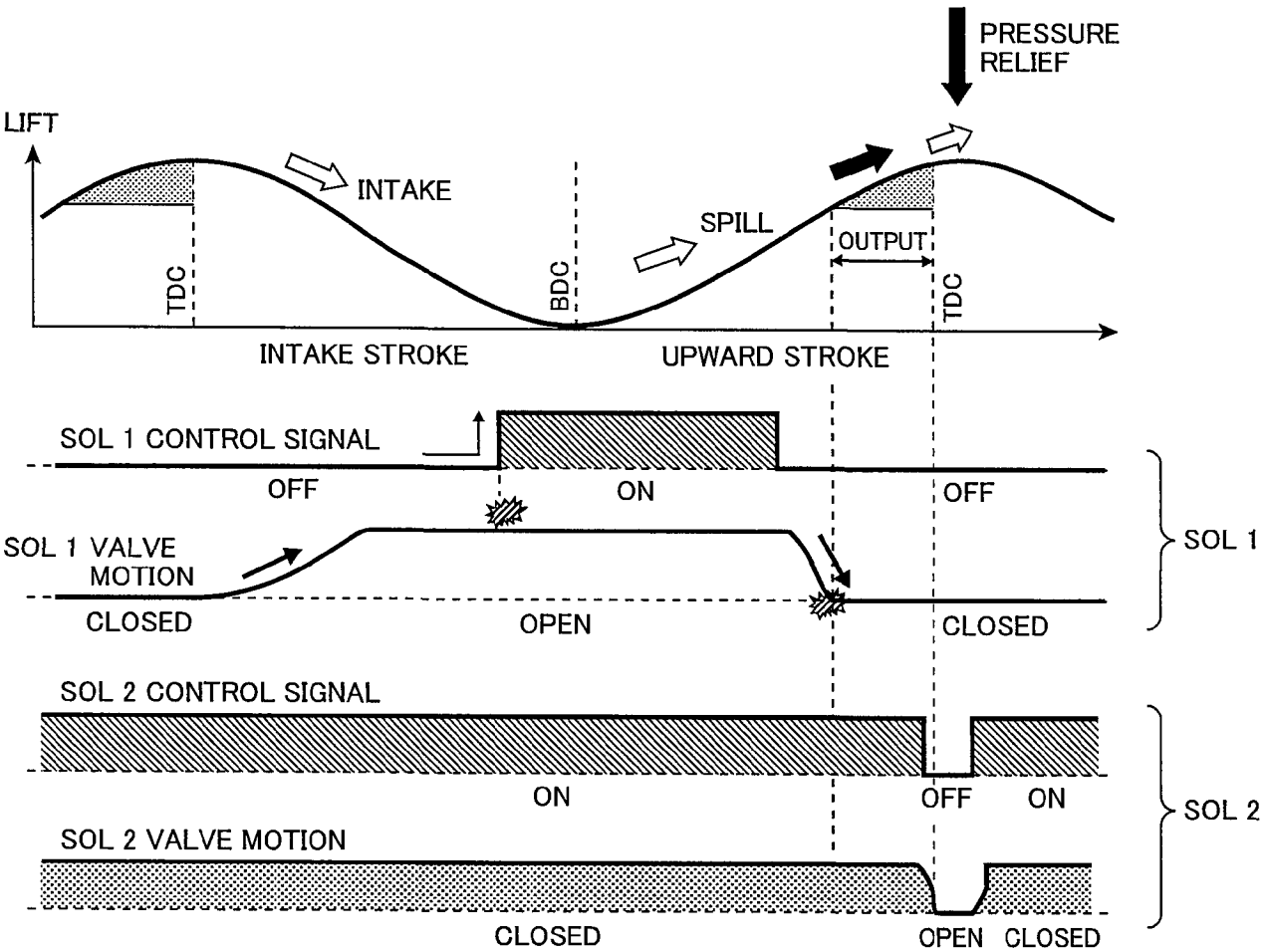
FIG. 12 shows a schematic drawing illustrating an example of a fourth mode of operation of the fuel system according to the present invention.
Figure 13:
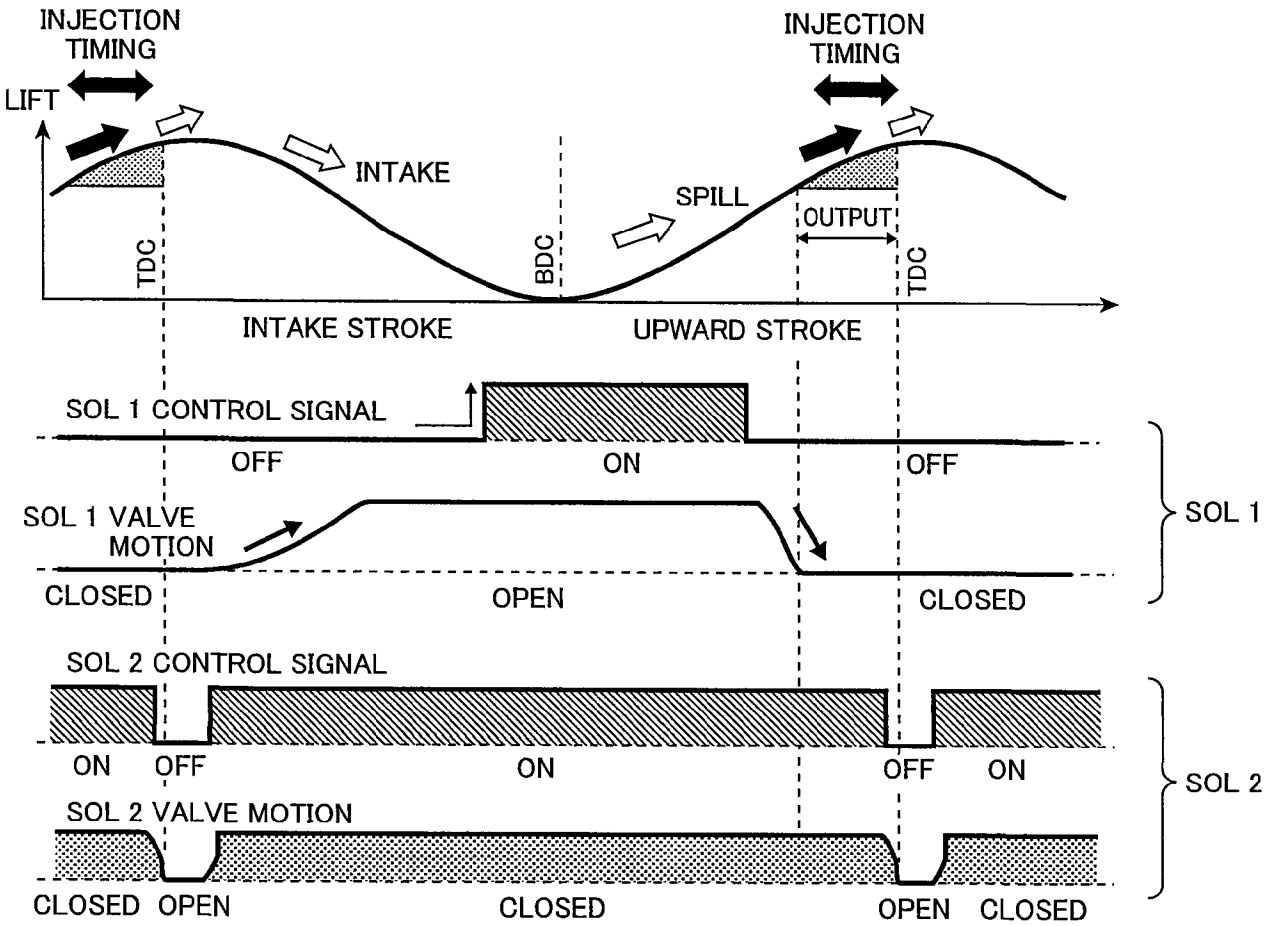
FIG. 13 shows a schematic drawing illustrating another example of the fourth mode of operation of the fuel system according to the present invention.

In a fourth operation mode of the high-pressure fuel supply pump 1 or the fuel system as illustrated in FIGS. 12 and 13, the fuel system or the high-pressure fuel supply pump 1 is controlled such that pressurizing fuel in the compression chamber 8 is started by deenergizing the first solenoid actuated valve SOL1 during an upward stroke of the plunger 9 while the second solenoid actuated valve SOL2 is kept energized, and pressurizing fuel is stopped by deenergizing the second solenoid actuated valve SOL2.

As shown in FIG. 12, the second solenoid actuated valve SOL2 can accordingly operate as an electrically-controlled pressure relief valve, wherein pressurizing fuel in the compression chamber 8 is stopped by deenergizing the second solenoid actuated valve SOL2 when the pressure in the high-pressure system (e.g. in the high-pressure fuel rail 12 and/or the high-pressure passage 11) exceeds a predetermined pressure threshold, wherein the pressure in the high-pressure system can be for example determined by a pressure sensor in the high-pressure fuel system (e.g. by a pressure sensor in the high-pressure fuel rail 12). Accordingly, the second solenoid actuated valve SOL2 can be used as a relief valve to spill the high-pressure fuel supply pump's output when the pressure in the high-pressure system exceeds a predetermined pressure threshold for possibly preventing further pressure build-up in the high-pressure fuel system e.g. in the high-pressure fuel rail 12. As can be seen from FIG. 12, if the second solenoid actuated valve SOL2 is deenergized (at the instance marked by the vertical arrow A), the spring 16 and/or the hydraulic force will force the second solenoid actuated valve SOL2 to open for relieving the compression chamber pressure so that discharging the fuel through the discharge valve 10 is stopped (applicable to a pull-type valve SOL2, i.e. the first and the third embodiments).

In case the valve SOL2 is provided not in the high-pressure fuel supply pump but in the high-pressure fuel supply system according to the third embodiment, the relief valve function may be further used to reduce the pressure in the high-pressure fuel system (e.g. the high-pressure fuel passage 11 and/or the high-pressure fuel rail 12). However, if the second solenoid actuated valve SOL2 is provided in the high-pressure fuel supply pump according to the first embodiment, it is not possible for the second solenoid actuated valve SOL2 to relieve the pressure in the high-pressure fuel system but only to interrupt an on-going pressure stroke and prevent further pressure build-up in the high-pressure fuel system.

Furthermore, as illustrated in FIG. 13, according to this fourth operation mode of the high-pressure fuel supply pump 1 or the fuel system, it is further possible to provide a highly advantageous increased flexibility for synchronizing the timing of the pressurization events with the direct injection timing in a high-pressure fuel supply mode such as a GDI mode. Such a synchronization can be achieved by using the first solenoid actuated valve SOL1 to control the timing for the start of pressurization stroke (by controlling the timing of deenergizing SOL1 during the upward stroke of the plunger 9), and by further using the second solenoid actuated valve SOL2 to control the end of the pressurization during the upward stroke of the plunger (by controlling the timing of deenergizing SOL2 during the upward stroke of the plunger 9). Accordingly, in this highly advantageous operation mode, the start time and the end time of the pressurization of fuel in the compression chamber 8 can be controlled separately so that both, the amount of discharged high-pressure fuel and the timing thereof can be controlled at the same time. According to the prior art, it is merely possible to either control the timing or the amount.

It should be remarked that for fully synchronizing the pressurizing events (start and end timing) with the injection events during high-pressure fuel supply mode such as GDI mode that the pump driving cam has to be configured such that it has a number of lobes being equal to the number of high-pressure fuel injectors, and furthermore such that it is oriented on the cam shaft at an angle such that the upward stroke of the plunger 9 coincides with the timing of the injection events at the desired engine condition.

(Fifth Mode of Operation—Alternative Operation Mode for High-Pressure Fuel Supply)

Figure 14:
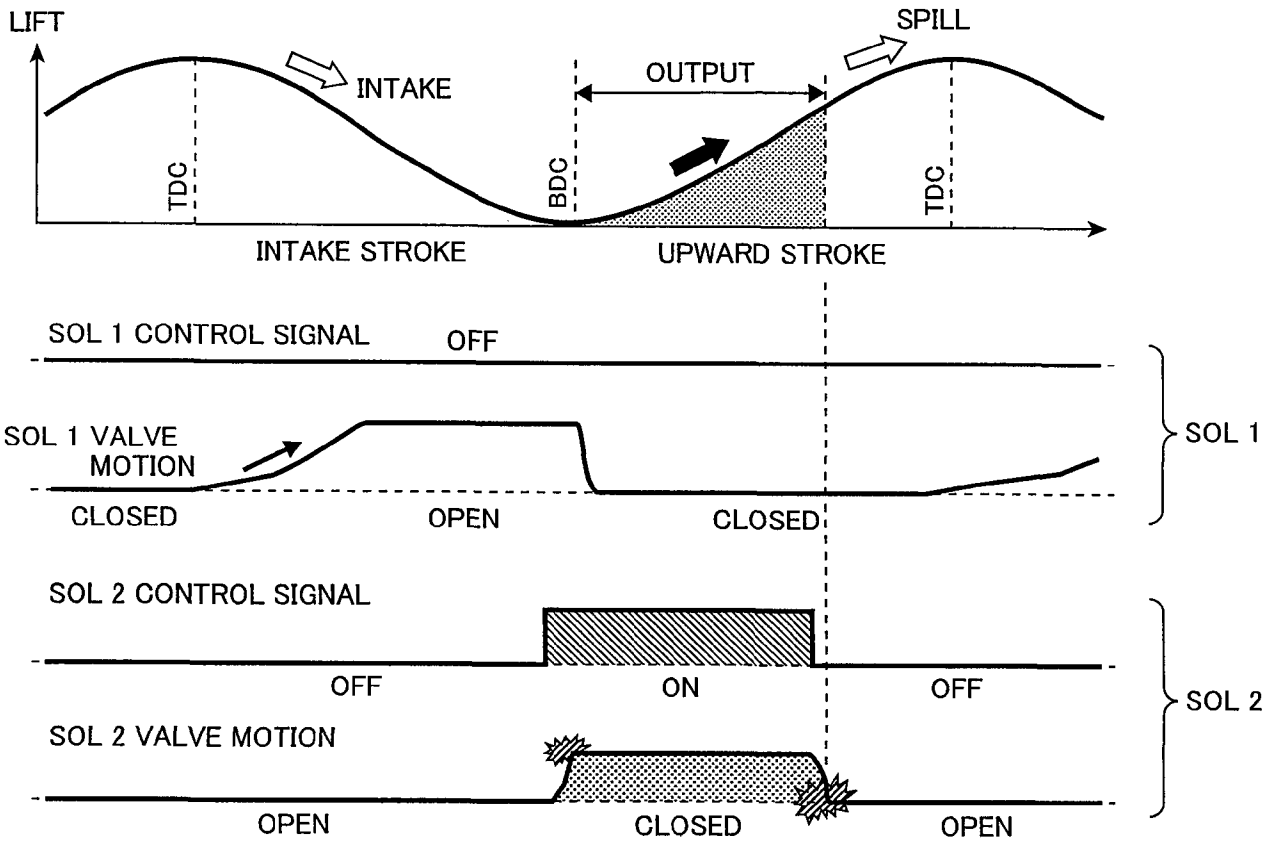
FIG. 14 shows a schematic drawing illustrating an example of a fifth mode of operation of the fuel system according to the present invention.
Figure 15:
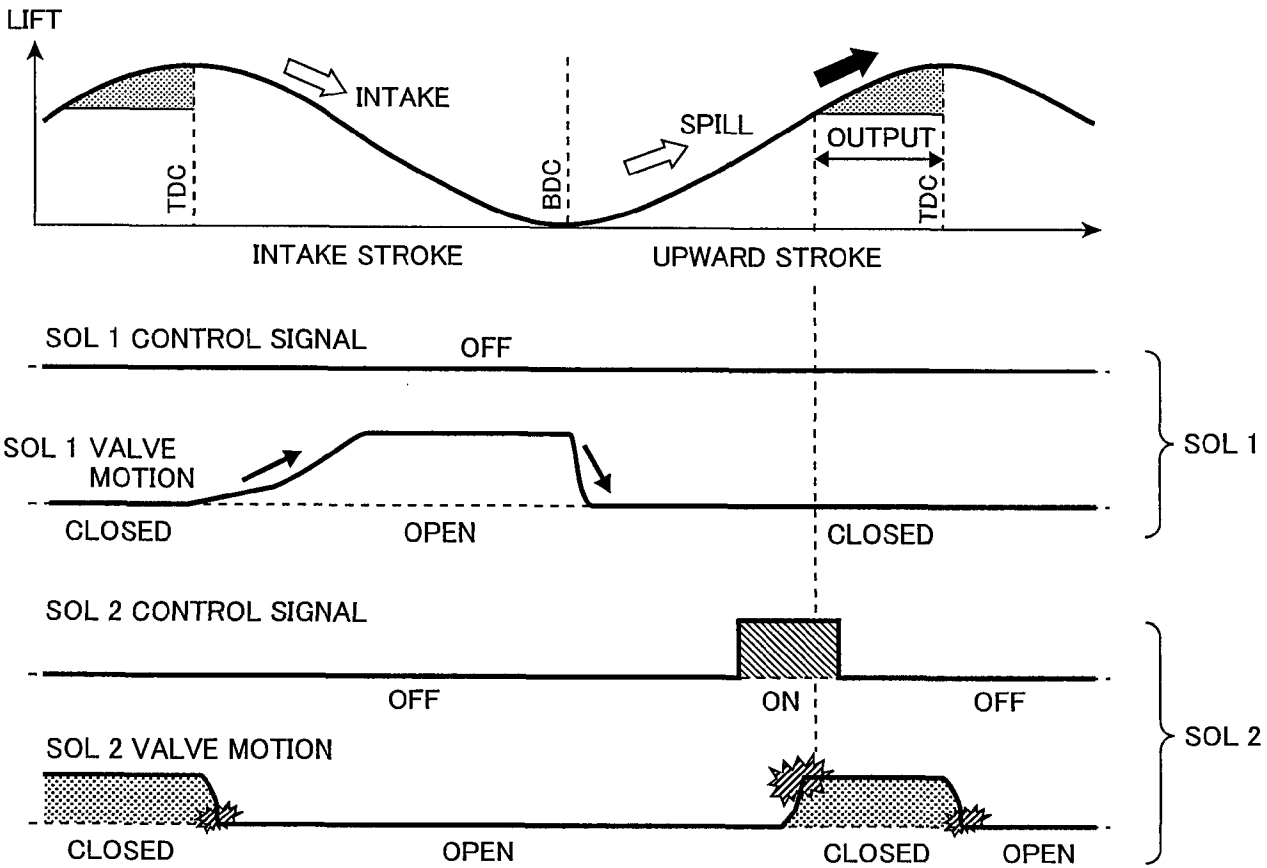
FIG. 15 shows a schematic drawing illustrating an example of a fifth mode of operation of the fuel system according to the present invention.

In a fifth operation mode of the high-pressure fuel supply pump 1 or the fuel supply system as shown in FIGS. 14 and 15, the high-pressure fuel supply pump 1 is controlled such that the first solenoid actuated valve SOL1 is continuously kept deenergized, wherein the second solenoid actuated valve SOL2 functions as an inlet valve for delivering low-pressure fuel into the compression chamber 8 during an intake stroke of the plunger 9 and/or as an spill valve for spilling low-pressure fuel out of the compression chamber 8 during an upward stroke of the plunger 8, wherein the second solenoid actuated valve SOL2 is energized during the upward stroke of the plunger 9 for closing the second solenoid actuated valve SOL2 so that fuel in the compression chamber 8 is pressurized and delivered to the high-pressure fuel supply system through the discharge valve 10.

According to this fifth operation mode, high-pressure fuel supply mode such as GDI mode can be alternatively be controlled also via the second solenoid actuated valve SOL2, i.e. without any control of the first solenoid actuated valve SOL1 which is kept continuously deegenergized. This fifth operational mode can be used for consuming less electrical energy (for example in case the amount of available electrical energy is reduced), but it will result in increased noise levels and vibrations due to the operation of the "normally open" solenoid valve. This fifth mode of operation may be most advantageously used in case of failure of the first solenoid actuated valve SOL2 so as to still provide the availability of a high-pressure fuel supply mode such as GDI mode in case of a failure of the first solenoid actuated valve SOL1. The fifth operation mode is illustrated in FIG. 14 for the first embodiment and in FIG. 15 for the second embodiment.

As can be seen in FIG. 14, the solenoid signal of the first solenoid actuated valve SOL1 remains OFF and no current is applied to the coil 14 of the first solenoid actuated valve SOL1. Still, the first solenoid actuated valve SOL1 is displaced due to a hydraulic force so that it opens in the intake stroke of the plunger 9. The second solenoid actuated valve SOL2 is released (by deenergization) during the intake stroke of the plunger 9 such that fuel intake can occur through the second solenoid actuated valve SOL2 (as well as through the first solenoid actuated valve SOL1 which opens by means of the hydraulic force) and for consuming less electrical energy. Before the plunger 9 reaches the BDC position, the second solenoid actuated valve SOL2 is energized such that the second solenoid actuated valve SOL2 is closed by means of magnetic force. When the upward stroke of the plunger 9 begins, the first solenoid actuated valve SOL1 is quickly closed by means of the hydraulic force and the second solenoid actuated valve SOL2 is kept closed by means of the magnetic force for pressurizing fuel and discharging high-pressure fuel via the discharge valve 10. At a time which can be precisely controlled by the engine control unit 7, the second solenoid actuated valve SOL2 is deenergized so as to open immediately (accompanied with a large impact noise) and fuel is spilled out so that pressurization of fuel is stopped.

As can be seen in FIG. 15, the solenoid signal of the first solenoid actuated valve SOL1 remains OFF and no current is applied to the coil 14 of the first solenoid actuated valve SOL1. Still, the first solenoid actuated valve SOL1 is displaced due to a hydraulic force so that it opens in the intake stroke of the plunger 9. The second solenoid actuated valve SOL2 is released (by deenergization) during the intake stroke of the plunger 9 such that fuel intake can occur through the second solenoid actuated valve SOL2 (as well as through the first solenoid actuated valve SOL1 which opens by means of the hydraulic force) and for consuming less electrical energy. The second solenoid actuated valve SOL2 is energized at a time during the upward stroke of the plunger 9 such that a predetermined amount of fuel is pressurized and discharged via the discharge valve 10. When the second solenoid actuated valve SOL2 is energized, the second solenoid actuated valve SOL2 is closed. Since also the "normally closed" first solenoid actuated valve SOL1 is kept closed by biasing force and hydraulic force, fuel is pressurized in the compression chamber 8 and discharged via the discharge valve 10.

(Sixth Mode of Operation—PWM Solenoid Control)

Figure 16:
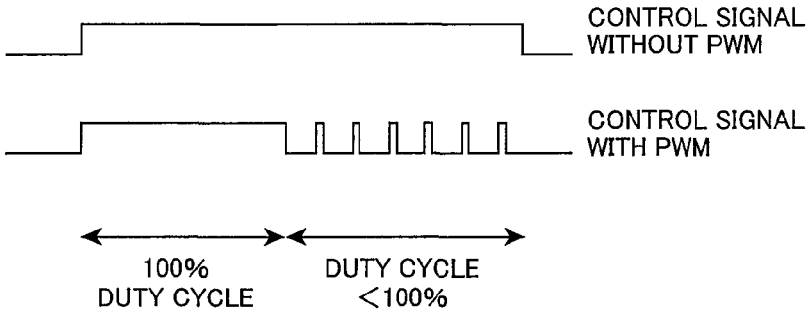
FIG. 16 shows a schematic drawing illustrating an example of a sixth mode of operation of the fuel system according to the present invention.

In a sixth mode of operation as illustrated in FIG. 16, the first solenoid actuated valve SOL1 and/or the second solenoid actuated valve SOL2 are controlled according to any of the above or below described modes of operation and are further controlled via pulse-width modulation when the solenoids are to be energized, wherein the first solenoid actuated valve SOL1 and/or the second solenoid actuated valve SOL2 are controlled at a duty cycle of substantially 100% after being energized for magnetizing the solenoid (directly after being switched on by applying current to the coils, current is continuously applied to the coil(s) at first). However, after a predetermined period of being energized, the first solenoid actuated valve SOL1 and/or the second solenoid actuated valve SOL are controlled at a duty cycle below 100% after magnetization of the respective solenoid for keeping the first solenoid actuated valve SOL1 and/or the second solenoid actuated valve SOL2 energized. Accordingly, the control signal is repeatedly switched between ON and OFF as shown in FIG. 16 which reduces the energy consumption of the mode of operation, while the solenoid(s) stay magnetized even if the control signal(s) is(are) controlled at a duty cycle below 100%.

According to this mode of operation, the solenoid(s) of the solenoid actuated valve(s) SOL1 and/or SOL2 will be controlled via a pulse-width modulated signal to reduce the electrical energy requirement depending on the required magnetic force. The duty-cycle of the PWM (pulse width modulation) signal is normally calibrated for different operating conditions to ensure the adequate magnetic force without unnecessarily expending electrical energy. At the start of the pulse, when the magnetization of the solenoid(s) is to be built up, a 100% duty cycle is applied to ensure fast current ramp up so as to cause the solenoid magnetization to buildup fast. After a short period of the 100% duty cycle, the operation is then continued at a smaller duty cycle signal at a duty cycle below 100%.

(Seventh Mode of Operation—Skipped Pulse Control)

The control of the solenoid(s) of the first solenoid actuated valve SOL1 and/or the second solenoid actuated valve SOL2 according to any of the above and below described modes of operation is normally repeated for every pump lobe, i.e. for each pair of intake stroke and upward stroke of the plunger 9 in the compression chamber 8. However, at conditions of low-fuel delivery requirement such as for example during an idling operation of the internal combustion engine, it is further possible to operate the solenoid(s) of the first solenoid actuated valve SOL1 and/or the second solenoid actuated valve SOL2 skipped-pulse control mode, i.e. performing a mode of operation of high-fuel supply as described above and below only for single pair of intake stroke and upward stroke of the plunger 9, while keeping the solenoids continuously deenergized during other pairs of intake stroke and upward stroke of the plunger 9. Then, in the single pair of intake stroke and upward stroke of the plunger 9, a large (or even full) amount of high-pressure fuel can be delivered, followed by a sequence of pump lobes (i.e. a sequence of pairs of intake strokes and upward strokes of the plunger 9) during which no high-pressure fuel is delivered. In this seventh mode of operation, a reduced noise level can be achieved and vibrations can be reduced. In the normal modes of high-pressure fuel supply as de scribed above and below, typically only a small amount of high-pressure fuel is required to be delivered during each pair of intake stroke and upward stroke of the plunger 9 at conditions of low high-pressure fuel delivery requirements.

The seventh mode of operation can be applied to all of the above and below described modes of high-pressure fuel supply operation where the described mode is, then, only applied in during one single pair of intake stroke and upward stroke of the plunger 9 followed by a sequence of pump lobes (i.e. a sequence of pairs of intake strokes and upward strokes of the plunger 9) during which no high-pressure fuel is delivered. The seventh mode of operation is exemplary illustrated in FIG. 17 for a supply of the full amount of high-pressure in which fuel is pressurized and discharged via the discharge valve 10 substantially during the full upward stroke of the plunger 9. A single high-pressure fuel discharge is followed by a sequence of the so-called skipped pulses in which no high-pressure fuel is delivered. During these skipped pulses fuel in the compression chamber 8 is spilled back via the first and/or the second solenoid actuated valves SOL 1 and SOL2 during the upward stroke of the plunger 9 so that fuel is not pressurized and no high-pressure fuel is discharged via the discharge valve 10.

Figure 17:
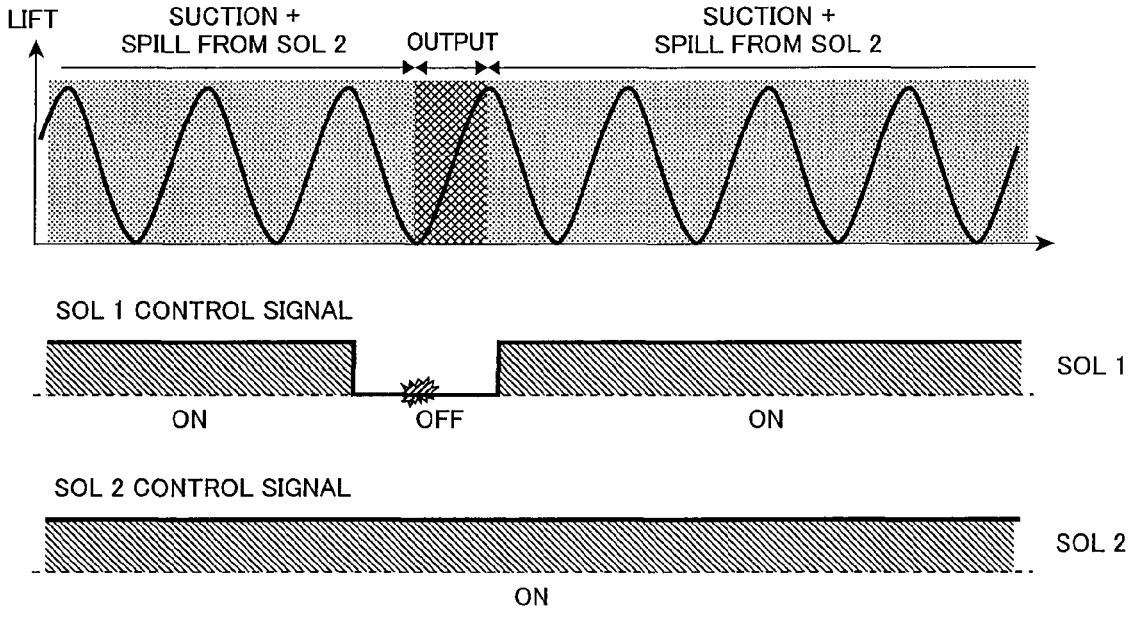
FIG. 17 shows a schematic drawing illustrating an example of a seventh mode of operation of the fuel system according to the present invention.

In FIG. 17, the second solenoid actuated valve SOL2 is continually kept energized so that no operation noise is generated by the second solenoid actuated valve SOL2. The first solenoid actuated valve SOL1 is normally also continually energized to keep it open. If a full high-pressure supply stroke is required, the first solenoid actuated valve SOL1 is the deenergized already during the single intake stroke and kept deenergized during the whole following upward stroke of the plunger 9 for pressurizing fuel in the compression chamber 8 and discharging the full amount of high-pressure fuel via the discharge valve 10. On the other hand, if only a partial high-pressure fuel delivery is required, then the first solenoid actuated valve SOL1 can be energized during the single intake stroke of the plunger 9 before the plunger reaches the BDC position so as to be deenergized again at an appropriate time during the upward stroke of the plunger 9 to deliver the correct amount of high-pressure fuel until this deenergization.

Figure 18:
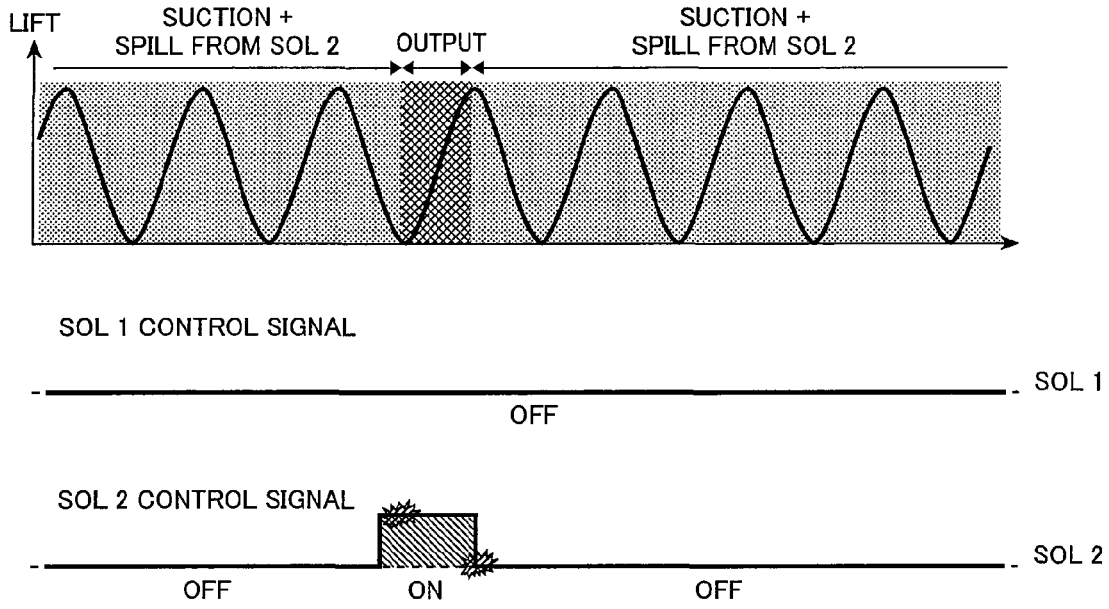
FIG. 18 shows a schematic drawing illustrating another example of the seventh mode of operation of the fuel system according to the present invention.

A further example of the seventh mode of operation is exemplary illustrated in FIG. 18, wherein the first solenoid actuated valve SOL1 can be continuously kept deenergized and the second solenoid actuated valve SOL2 (push-type) is controlled so as to be energized during a single upward stroke of the plunger 9 to be closed and kept closed during the single upward stroke of the plunger 9 for discharging a full amount of high-pressure fuel during the single upward stroke followed by a sequence of the so-called skipped pulses in which no high-pressure fuel is delivered. Compared to the example control mode of FIG. 17, this requires significantly less electrical energy, however, some of the noise-reduction advantage is lost. Still, the total noise level is still very low. Furthermore, this mode can be used in case of a failure of the first solenoid actuated valve SOL1.

Figure 19:
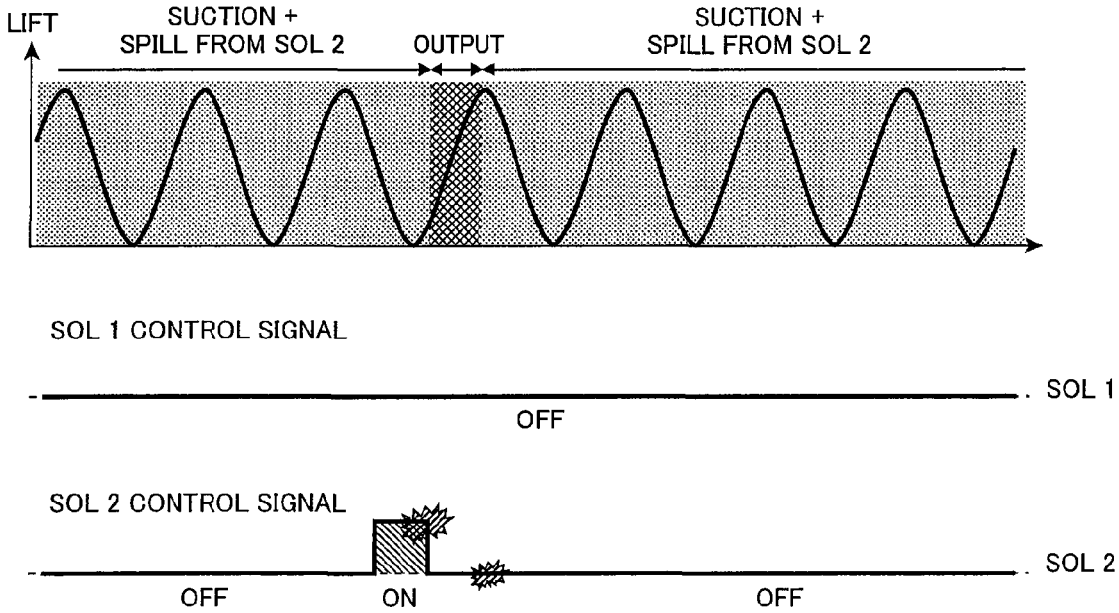
FIG. 19 shows a schematic drawing illustrating another example of the seventh mode of operation of the fuel system according to the present invention.

A yet further example of the seventh mode of operation is exemplary illustrated in FIG. 19, wherein the first solenoid actuated valve SOL1 can be continuously kept deenergized and the second solenoid actuated valve SOL2 (pull-type) is controlled so as to be energized during a single upward stroke of the plunger 9 to be closed and kept closed during the single upward stroke of the plunger 9 for discharging a full amount of high-pressure fuel during the single upward stroke followed by a sequence of the so-called skipped pulses in which no high-pressure fuel is delivered. It is to be noted that the second solenoid actuated valve SOL2 of the pull-type does not have to be energized during the whole upward stroke of the plunger 9 since it will be kept closed by the hydraulic force during the single upward stroke of the plunger 9. Accordingly, the second solenoid actuated valve SOL2 is deenergized already short after the beginning of the single upward stroke in the example of FIG. 19, however, it is kept closed until the end of the single upward stroke when the plunger 9 reaches the TDC position by means of the hydraulic force and fuel will be pressurized and discharged at high-pressure until the end of the single upward stroke. Compared to the example control mode of FIG. 17, this requires significantly less electrical energy, however, some of the noise-reduction advantage is lost. Still, the total noise level is still very low. Furthermore, this mode can be used in case of a failure of the first solenoid actuated valve SOL1.

(Eighth Mode of Operation—Alternative Operation Mode for High-Pressure Fuel Supply)

Figure 20:
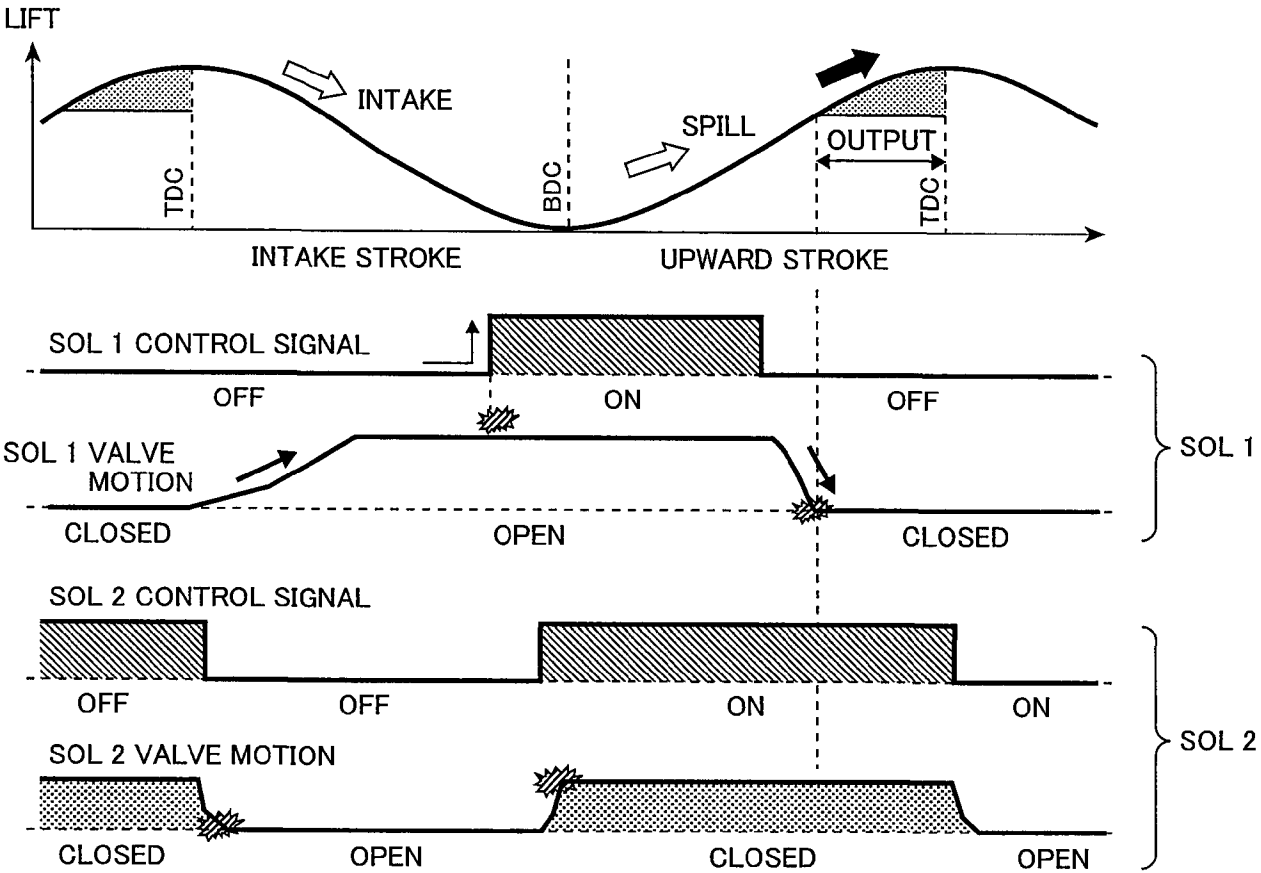
FIG. 20 shows a schematic drawing illustrating an example of an eighth mode of operation of the fuel system according to the present invention.

In an eight operation mode of the high-pressure fuel supply pump 1 or the fuel supply system as illustrated in FIG. 20, the high-pressure fuel supply pump 1 or the fuel supply system is controlled such that the second solenoid actuated valve SOL2 is deenergized during the intake stroke of the plunger 9 and energized during the upward stroke of the plunger 9 for keeping the second solenoid actuated valve SOL2 closed during the whole upward stroke of the plunger 9, wherein the first solenoid actuated valve SOL1 is operated similar to the mode of operation according to the above-described second mode of operation. Although this mode of operation leads to an increased noise level, the energy consumption can be advantageously reduced compared to the second mode of operation.

In this mode of operation as illustrated in FIG. 20, the second solenoid actuated valve SOL2 is deenergized during the intake stroke of the plunger 9. The second solenoid actuated valve SOL2 will hence quickly open by spring force and/or hydraulic pressure, thereby generating noise. Then, during the intake stroke, fuel will be drawn into the compression chamber from both the first solenoid actuated valve SOL1 and the second solenoid actuated valve SOL2. During the intake stroke before the plunger 9 reaches the BDC position, the second solenoid actuated valve SOL2 is energized for being closed and kept closed (resulting in a large impact noise). As the first solenoid actuated valve SOL1 is deenergized during the upward stroke of the plunger so as to close, fuel is pressurized in the compression chamber 8 and high-pressure fuel is discharged via the discharge valve 10.

(Ninth Mode of Operation—Failure Mode Operation)

According to the structure of the first, second and third embodiments, there is provided the highly advantageous possibility of a failure mode operation in which the second solenoid actuated valve SOL2 is controlled to enable the driver to drive the vehicle for repair (e.g., if the first solenoid actuated valve SOL1 has a failure). Especially for the third embodiment, since the second solenoid actuated valve SOL2 is not provided as a part of the high-pressure fuel supply pump 1, the control of the second solenoid actuated valve SOL2 does also not require to be synchronized with the position of the lobe of the high-pressure fuel supply pump (i.e. the position of the plunger 9), so that its control in the third embodiment does not require any input from sensors of the internal combustion engine indicating this position which further provides the highly advantageous possibility as a failure mode of operation in case the position sensors in the internal combustion engine have a failure.

(Tenth Mode of Operation—Operation Mode for Low-Pressure Fuel Supply)

As mentioned above, by providing a flow-rate reducing means such as an orifice 33 in the low-pressure fuel main passage 5 between the first and second low-pressure fuel passages 3 and 4 in any of the described embodiments of the present invention, it is also possible to use the high-pressure fuel supply pump 1 during low-pressure fuel supply mode such as PFI mode. Then, the low-pressure fuel pump of the fuel tank 2 may be configured to supply low-pressure at a pressure which is lower than the low-pressure level required for low-fuel supply mode such as PFI mode and control the pressure of low-pressure fuel in the low-pressure fuel rail 6 by using the second solenoid actuated valve SOL2. Then, a pressure sensor means 34 in the low-pressure fuel rail 6 would be required for precise closed loop control of the pressure in the low-pressure system on the low-pressure fuel rail side of the flow-rate reducing means such as an orifice 33.

Such a configuration is exemplary shown for the third embodiment in FIG. 8. Here, the current applied to the solenoid of the second solenoid actuated valve SOL2 can be precisely controlled such that the opening of the push-rod 18 of the push type second solenoid actuated valve SOL2 is configured such as to spill back a required amount of fuel from the high-pressure fuel rail 12 to the low-pressure system until the required (e.g. predetermined) fuel pressure in the low-pressure fuel rail is obtained.

(Summary)

Summarizing, the present invention provides a high-pressure fuel supply pump and a fuel system configured to supply low-pressure fuel in a low-pressure fuel supply mode such as a PFI mode to an internal combustion engine and which is further configured to supply high-pressure fuel in a high-pressure fuel supply mode such as a GDI mode to an internal combustion engine, i.e. a hybrid high-pressure/low-pressure fuel supply system such as a PFI/GDI hybrid fuel supply system for efficiently reducing the soot emissions of the internal combustion engine.

According to the single general inventive concept of the present invention, there is provided a first solenoid actuated valve for connecting and disconnecting a first low-pressure fuel passage and the compression chamber of a high-pressure fuel supply pump and a second solenoid actuated valve for connecting and disconnecting a second low-pressure fuel passage and the compression chamber or at least for connecting and disconnecting the second low-pressure fuel passage and a high-pressure fuel passage of a high-pressure fuel supply system. According to the general inventive concept of the present invention, the first solenoid actuated valve is biased by a first biasing member in a closing direction of the first solenoid actuated valve and the first solenoid actuated valve is opened or kept open against the biasing force of the first biasing member, when said first solenoid actuated valve is energized, and the second solenoid actuated valve is configured to be closed, when said second solenoid actuated valve is energized, and the first low-pressure fuel passage and the second low-pressure fuel passage are connected to a low-pressure fuel supply system for supplying low-pressure fuel to the internal combustion engine.

The basic inventive idea is to combine two types of solenoid actuated valves, namely, a so-called "normally closed" solenoid actuated valve of the "normally closed"-type and a so-called "normally open" solenoid actuated valve of the "normally open"-type, in one single high-pressure fuel pump or in one fuel supply system such that the high-pressure fuel pump or the fuel supply system can achieve the benefit of sufficient flow rate and low impact noise as provided by a "normally closed" solenoid actuated valve high-pressure fuel supply pump configuration and which, in addition, has the functionality provided by a "normally open" solenoid actuated valve, which does not deliver fuel when there is no control signal such that the "normally open" solenoid actuated valve is deenergized. At the same time, the present invention provides the additional advantage that fuel recirculation during PFI injection operation mode is enabled for cooling down the high-pressure pump and the low fuel-passages with fresh fuel by connecting the compression chamber and the low-pressure fuel passage.

The present invention provides a fuel supply system which utilizes the merits of both types of solenoid valves, i.e. a "normally closed" solenoid valve and a "normally open" solenoid valve. Additionally, as described above, the configuration of the present invention provides plural various possible modes of operation (modes of solenoid control) which can be used depending on the various requirements. The above-described examples, aspects and features of the plural embodiments of the present invention may be combined in any way, party or as a whole. In particular, features, components and specific details of the structures of the above-described embodiments and particular examples thereof may be exchanged or combined to form further embodiments optimized for the respective application. As far as those modifications are apparent for an expert skilled in the art they shall be disclosed implicitly by the above description without specifying explicitly every possible combination.

The invention claimed is:

1. A high-pressure fuel supply pump, comprising:

a compression chamber, a plunger reciprocating in said compression chamber for pressurizing fuel in said compression chamber, a discharge valve for discharging pressurized fuel from said compression chamber to a high-pressure fuel passage of a high-pressure fuel supply system for supplying high-pressure fuel to an internal combustion engine, and a first solenoid actuated valve for connecting and disconnecting a first low-pressure fuel passage and the compression chamber, wherein said first solenoid actuated valve is biased by a first biasing member in a closing direction of said first solenoid actuated valve, and said first solenoid actuated valve is opened or kept open against the biasing force of said first biasing member, when said first solenoid actuated valve is energized, characterized by a second solenoid actuated valve for connecting and disconnecting a second low-pressure fuel passage and said compression chamber, wherein said second solenoid actuated valve is configured to be closed, when said second solenoid actuated valve is energized, and said first low-pressure fuel passage and said second low-pressure fuel passage are connected to a low-pressure fuel supply system for supplying low-pressure fuel to said internal combustion engine, and characterized in that said second solenoid actuated valve is configured without any biasing member such that the second solenoid actuated valve is opened by hydraulic force during an upward stroke of the plunger, when the second solenoid actuated valve is deenergized, and wherein the second solenoid actuated valve is further configured to be closed or kept closed against the hydraulic force, when the second solenoid actuated valve is energized.

* * * * *